US010977998B2

(12) United States Patent
Lee et al.

(10) Patent No.: US 10,977,998 B2
(45) Date of Patent: Apr. 13, 2021

(54) PIXEL CIRCUIT

(71) Applicant: Samsung Display Co., Ltd., Yongin-Si (KR)

(72) Inventors: Hyo Jin Lee, Yongin-si (KR); Joon-Chul Goh, Suwon-si (KR); Sangan Kwon, Cheonan-si (KR); Hui Nam, Suwon-si (KR); Jin Young Roh, Hwaseong-si (KR); Sehyuk Park, Seongnam-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 16/943,293

(22) Filed: Jul. 30, 2020

(65) Prior Publication Data

US 2021/0056895 A1 Feb. 25, 2021

(30) Foreign Application Priority Data

Aug. 21, 2019 (KR) ..... 10-2019-0102679

(51) Int. Cl.
*G09G 3/3233* (2016.01)
*G09G 3/325* (2016.01)
*G09G 3/3275* (2016.01)

(52) U.S. Cl.
CPC ..... *G09G 3/325* (2013.01); *G09G 3/3275* (2013.01)

(58) Field of Classification Search
CPC ..... G09G 3/325; G09G 3/3275; G09G 3/3233
See application file for complete search history.

(56) References Cited

U.S. PATENT DOCUMENTS 9,349,321 B2 * 5/2016 Chen ..... G09G 3/3291
2011/0134100 A1 * 6/2011 Chung ..... G09G 3/325 345/212
2013/0038621 A1 * 2/2013 Choi ..... G06T 1/60 345/589

(Continued)

FOREIGN PATENT DOCUMENTS

KR 1020130118459 A 10/2013
KR 1020160096787 A 8/2016

(Continued)

*Primary Examiner* — Ibrahim A Khan
(74) *Attorney, Agent, or Firm* — Cantor Colburn LLP

(57) ABSTRACT

A pixel circuit includes a main-circuit that controls an organic light-emitting element by controlling a driving current to flow into the organic light-emitting element and a sub-circuit including a first compensation transistor including a gate terminal which receives a first gate signal, a second compensation transistor including a gate terminal which receives a second gate signal, and an initialization transistor including a gate terminal which receives an initialization signal. Here, in a low-frequency driving mode, a driving frequency of the first gate signal is N hertz (Hz), a driving frequency of the initialization signal is N Hz, a driving frequency of the second gate signal is M Hz, the first compensation transistor and the initialization transistor are turned on during a first time duration in N non-light-emitting periods per second, and the second compensation transistor is turned on during a second time duration in M non-light-emitting periods per second.

20 Claims, 12 Drawing Sheets

(56) References Cited

U.S. PATENT DOCUMENTS

| | | | | |
|---|---|---|---|---|
| 2014/0092078 | A1* | 4/2014 | Yoon | G09G 3/3696 345/212 |
| 2015/0287361 | A1* | 10/2015 | Lee | G09G 3/3233 315/172 |
| 2016/0232849 | A1* | 8/2016 | Jeon | G09G 3/3233 |
| 2016/0321994 | A1* | 11/2016 | Lee | G09G 3/2003 |
| 2017/0004772 | A1* | 1/2017 | Han | G09G 3/3258 |
| 2017/0092178 | A1* | 3/2017 | Lee | G09G 3/3233 |
| 2017/0098413 | A1* | 4/2017 | Lee | G11C 19/28 |
| 2017/0148384 | A1* | 5/2017 | Lee | G09G 3/3233 |
| 2017/0256199 | A1* | 9/2017 | Bi | G09G 3/20 |
| 2018/0158407 | A1* | 6/2018 | Chai | G09G 3/3266 |
| 2018/0166010 | A1* | 6/2018 | Park | G09G 3/3233 |
| 2020/0226978 | A1* | 7/2020 | Lin | H01L 27/3262 |

FOREIGN PATENT DOCUMENTS

| | | | |
|---|---|---|---|
| KR | 1020180063425 | A | 6/2018 |
| KR | 1020190012303 | A | 2/2019 |

* cited by examiner

PIXEL CIRCUIT

This application claims priority to Korean Patent Application No. 10-2019-0102679, filed on Aug. 21, 2019, and all the benefits accruing therefrom under 35 U.S.C. § 119, the content of which in its entirety is herein incorporated by reference.

BACKGROUND

1. Field

Embodiments relate generally to a pixel circuit. More particularly, embodiments of the invention relate to a pixel circuit including an organic light-emitting element (e.g., an organic light-emitting diode), a storage capacitor, a switching transistor, a driving transistor, an emission control transistor, a compensation transistor, an initialization transistor, etc.

2. Description of the Related Art

Generally, a pixel circuit included in an organic light-emitting display device may include an organic light-emitting element, a storage capacitor, a switching transistor, a driving transistor, an emission control transistor, a compensation transistor, an initialization transistor, etc. Here, when the transistors are low temperature poly silicon ("LTPS") transistors, a flicker may occur when the organic light-emitting display device is driven at a driving frequency less than a predetermined driving frequency (e.g., less than 30 hertz (Hz)). In other words, because a leakage current flows through the transistors even when the transistors are turned off, a data signal stored in the storage capacitor (i.e., a voltage of a gate terminal of the driving transistor) may be changed by the leakage current when the organic light-emitting display device operates in a low-frequency driving mode, and thus a viewer (or user) may recognize a luminance-change. In particular, when the pixel circuit has a structure (e.g., a structure in which the gate terminal of the driving transistor, one terminal of the storage capacitor, one terminal of the initialization transistor, and one terminal of the compensation transistor are connected at a predetermined node) which sequentially performs an initializing operation, a threshold voltage compensating and data writing operation, and a light-emitting operation, the data signal stored in the storage capacitor (i.e., the voltage of the gate terminal of the driving transistor) may be changed because the leakage current flows through the compensation transistor and the initialization transistor even when the compensation transistor and the initialization transistor are turned off Thus, a conventional pixel circuit reduces the leakage current flowing through the compensation transistor and the initialization transistor by including the compensation transistor having a dual structure and/or the initialization transistor having a dual structure.

SUMMARY

A conventional pixel circuit has a limit that an effect of reducing the leakage current is slight when an organic light-emitting display device operates in the low-frequency driving mode.

Some embodiments provide a pixel circuit preventing a flicker that a viewer recognizes by minimizing (or reducing) a change in a voltage of a gate terminal of a driving transistor, which is caused by a leakage current flowing through a compensation transistor and an initialization transistor when an organic light-emitting display device operates in a low-frequency driving mode An embodiment of a pixel circuit may include a main circuit including a driving transistor that includes a gate terminal that is connected to a first node, a first terminal that is connected to a second node, and a second terminal that is connected to a third node and an organic light-emitting element that is connected to the driving transistor between a first power voltage and a second power voltage and controls the organic light-emitting element to emit light by controlling a driving current corresponding to a data signal that is applied via a data line to flow into the organic light-emitting element, and a sub circuit including a first compensation transistor that includes a gate terminal that receives a first gate signal, a first terminal that is connected to the first node, and a second terminal that is connected to a fourth node, a second compensation transistor that includes a gate terminal that receives a second gate signal, a first terminal that is connected to the fourth node, and a second terminal that is connected to the third node, and an initialization transistor that includes a gate terminal that receives an initialization signal, a first terminal that is connected to the first node, and a second terminal that receives an initialization voltage. Here, in a low-frequency driving mode, a driving frequency of the first gate signal may be N hertz (Hz), which is a driving frequency of an organic light-emitting display device, where N is a positive integer, a driving frequency of the initialization signal may be N Hz, a driving frequency of the second gate signal may be M Hz, where M is a positive integer and different from N, the first compensation transistor and the initialization transistor may be turned on during a first time duration in N non-light-emitting periods per second, and the second compensation transistor may be turned on during a second time duration in M non-light-emitting periods per second.

In an embodiment, in the low-frequency driving mode, the driving frequency of the first gate signal and the driving frequency of the initialization signal may be lower than the driving frequency of the second gate signal.

In an embodiment, the first gate signal and the second gate signal may be generated, respectively by respective signal generating circuits that are independent of each other.

In an embodiment, the first time duration may be equal to the second time duration.

In an embodiment, a turn-on voltage level period of the second gate signal may be consistent with a turn-on voltage level period of the first gate signal.

In an embodiment, in a normal non-light-emitting period in which an initializing operation and a threshold voltage compensating and data writing operation are performed, the first compensation transistor and the second compensation transistor may be simultaneously turned on and then off after the initialization transistor is turned on and then off.

In an embodiment, in a hold non-light-emitting period in which the initializing operation and the threshold voltage compensating and data writing operation are not performed, only the second compensation transistor may be turned on and then off.

In an embodiment, the initialization voltage may be changed from a first voltage level to a second voltage level that is higher than the first voltage level at a start point of the hold non-light-emitting period, and the initialization voltage may be reset to the first voltage level at a start point of the normal non-light-emitting period.

In an embodiment, the initialization voltage may be additionally changed to at least one voltage level that is higher than the second voltage level after the initialization voltage is changed to the second voltage level at the start point of the hold non-light-emitting period.

In an embodiment, the first time duration may be longer than the second time duration.

In an embodiment, a turn-on voltage level period of the second gate signal may overlap a turn-on voltage level period of the first gate signal.

In an embodiment, a start point of the turn-on voltage level period of the second gate signal may be consistent with a start point of the turn-on voltage level period of the first gate signal, and an end point of the turn-on voltage level period of the second gate signal may be before an end point of the turn-on voltage level period of the first gate signal.

In an embodiment, a start point of the turn-on voltage level period of the second gate signal may be after a start point of the turn-on voltage level period of the first gate signal, and an end point of the turn-on voltage level period of the second gate signal may be consistent with an end point of the turn-on voltage level period of the first gate signal.

In an embodiment, a start point of the turn-on voltage level period of the second gate signal may be after a start point of the turn-on voltage level period of the first gate signal, and an end point of the turn-on voltage level period of the second gate signal may be before an end point of the turn-on voltage level period of the first gate signal.

In an embodiment, in a normal non-light-emitting period in which an initializing operation and a threshold voltage compensating and data writing operation are performed, the second compensation transistor may be turned on and then off while the first compensation transistor is turned on after the initialization transistor is turned on and then off.

In an embodiment, in a hold non-light-emitting period in which the initializing operation and the threshold voltage compensating and data writing operation are not performed, only the second compensation transistor may be turned on and then off.

In an embodiment, the initialization voltage may be changed from a first voltage level to a second voltage level that is higher than the first voltage level at a start point of the hold non-light-emitting period, and the initialization voltage may be reset to the first voltage level at a start point of the normal non-light-emitting period.

In an embodiment, the initialization voltage may be additionally changed to at least one voltage level that is higher than the second voltage level after the initialization voltage is changed to the second voltage level at the start point of the hold non-light-emitting period.

In an embodiment, the sub circuit may further include a bypass transistor including a gate terminal that receives a bypass signal, a first terminal that receives the initialization voltage, and a second terminal that is connected to an anode of the organic light-emitting element. In addition, in the low-frequency driving mode, a driving frequency of the bypass signal may be N Hz, and the bypass transistor may be turned on during the first time duration in N non-light-emitting periods per second.

In an embodiment, the bypass signal may be a same signal as the initialization signal.

Therefore, a pixel circuit in embodiments may minimize (or reduce) a leakage current flowing through a first compensation transistor and an initialization transistor when an organic light-emitting display device operates in a low-frequency driving mode by having a structure that includes a first compensation transistor and a second compensation transistor that are connected in series between a gate terminal of a driving transistor and one terminal of the driving transistor, where one terminal of the first compensation transistor is connected to the gate terminal of the driving transistor, and one terminal of the second compensation transistor is connected to the one terminal of the driving transistor, by turning on the first compensation transistor and the initialization transistor during a first time duration in N non-light-emitting periods per second, where N is a positive integer, when the organic light-emitting display device operates in the low-frequency driving mode (i.e., a driving frequency of a first gate signal that controls the first compensation transistor and a driving frequency of an initialization signal that controls the initialization transistor may be N Hz, which is a driving frequency of the organic light-emitting display device), and by turning on the second compensation transistor during a second time duration in M non-light-emitting periods per second, where M is an integer greater than N, when the organic light-emitting display device operates in the low-frequency driving mode (i.e., a driving frequency of a second gate signal that controls the second compensation transistor may be M Hz, which is higher than the driving frequency of the organic light-emitting display device). Thus, the pixel circuit may prevent (or reduce) a flicker that a viewer recognizes (i.e., may prevent a change in a voltage of the gate terminal of the driving transistor).

BRIEF DESCRIPTION OF THE DRAWINGS

Illustrative, non-limiting embodiments will be more clearly understood from the following detailed description in conjunction with the accompanying drawings.

DETAILED DESCRIPTION

Figure 1:
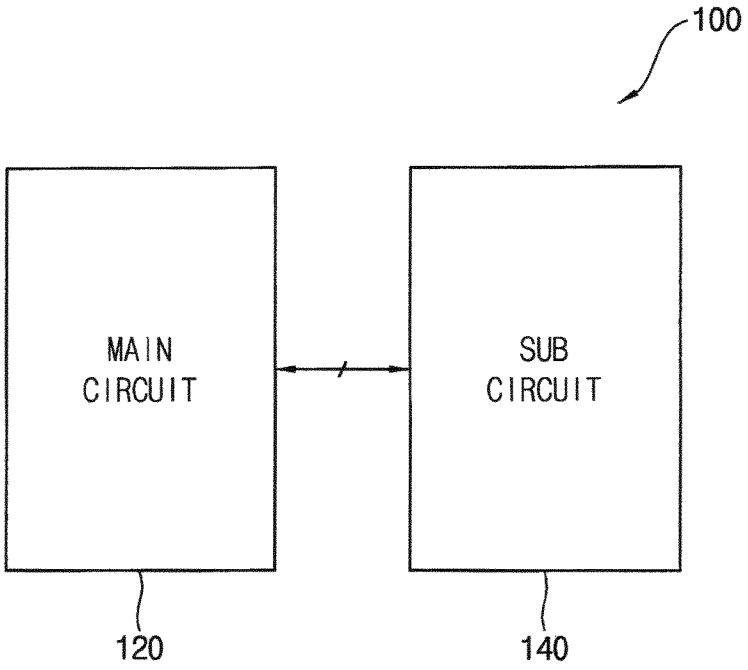
FIG. 1 is a block diagram illustrating an embodiment of a pixel circuit.

Hereinafter, embodiments of the invention will be explained in detail with reference to the accompanying drawings.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Embodiments are described herein with reference to cross section illustrations that are schematic illustrations of idealized embodiments. As such, variations from the shapes of the illustrations as a result, for example, of manufacturing techniques and/or tolerances, are to be expected. Thus, the invention should not be construed as limited to the particular shapes of regions as illustrated herein but are to include deviations in shapes that result, for example, from manufacturing. In an embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

Figure 2:
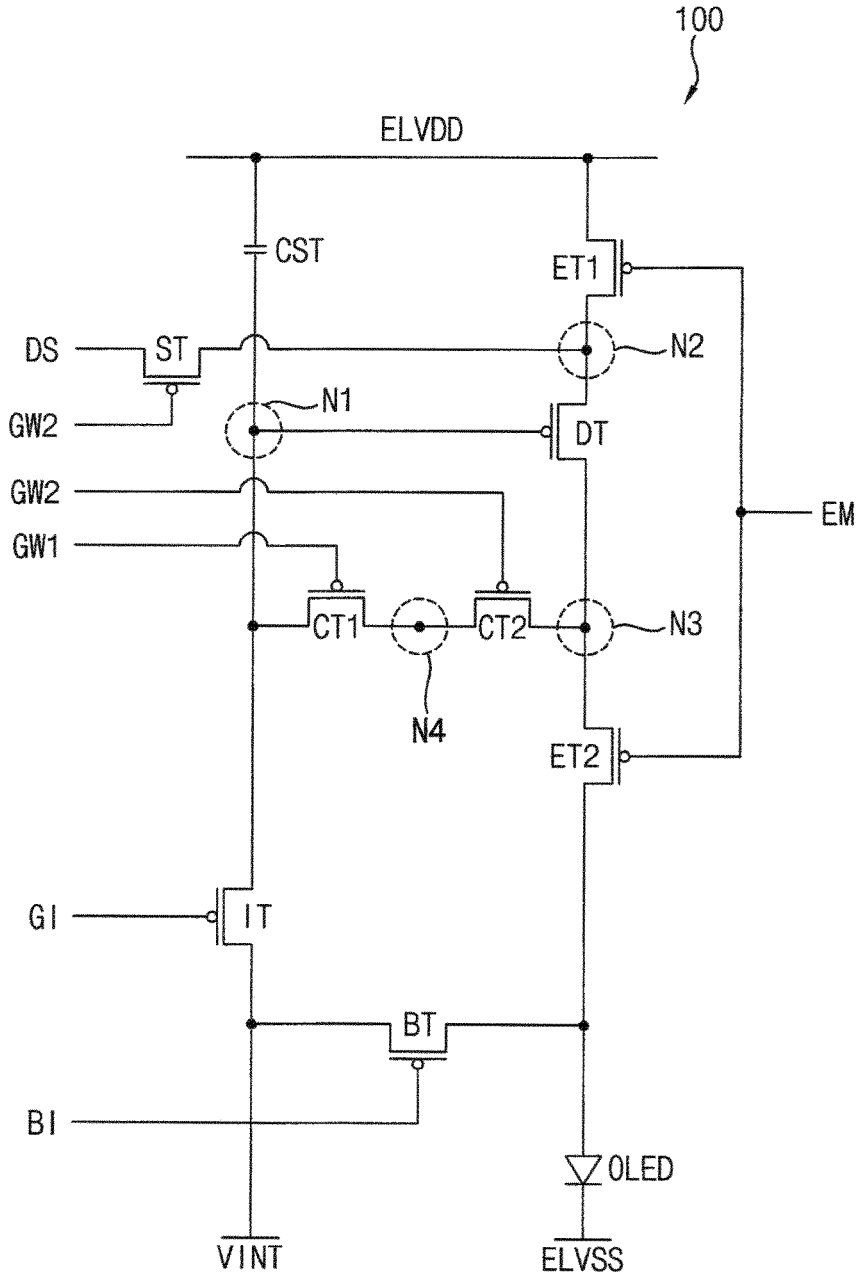
FIG. 2 is a circuit diagram illustrating an example of the pixel circuit of FIG. 1.
Figure 3:
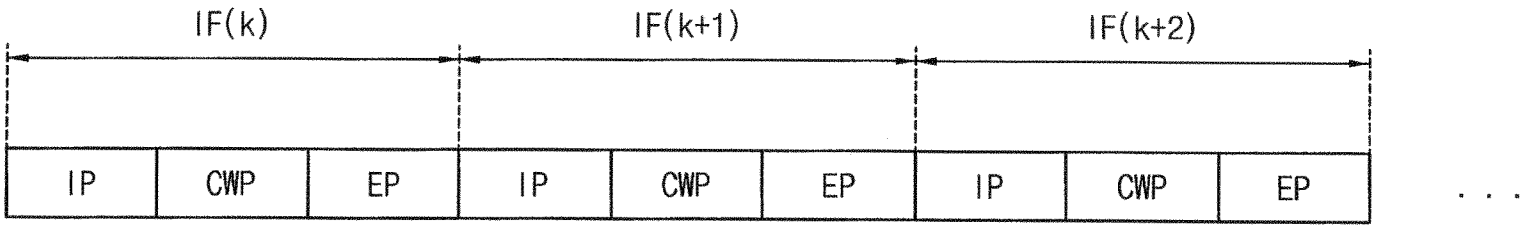
FIG. 3 is a diagram illustrating an example in which the pixel circuit of FIG. 2 operates.

FIG. 1 is a block diagram illustrating an embodiment of a pixel circuit, FIG. 2 is a circuit diagram illustrating an example of the pixel circuit of FIG. 1, and FIG. 3 is a diagram illustrating an example in which the pixel circuit of FIG. 2 operates.

Referring to FIGS. 1 to 3, the pixel circuit 100 may include a main circuit 120 and a sub circuit 140. In an embodiment, as illustrated in FIG. 3, the pixel circuit 100 may sequentially perform a non-light-emitting period (i.e., an initializing period IP and a threshold voltage compensating and data writing period CWP) and a light-emitting period EP in each image frame IF(k), IF(k+1), and IF(k+2) where k is a natural number, for example. Here, the non-light-emitting period IP+CWP may correspond to a turn-off voltage level period of an emission control signal EM, and the light-emitting period EP may correspond to a turn-on voltage level period of the emission control signal EM.

The main circuit 120 may include a driving transistor DT and an organic light-emitting element OLED that are connected in series between a first power voltage ELVDD and a second power voltage ELVSS. The main circuit 120 may control the organic light-emitting element OLED to emit light by controlling a driving current corresponding to a data signal DS that is applied via a data line to flow into the organic light-emitting element OLED. In an embodiment, as illustrated in FIG. 2, the main circuit 120 may include an organic light-emitting element OLED, a storage capacitor CST, a switching transistor ST, a driving transistor DT, a first emission control transistor ET1, and a second emission control transistor ET2, for example. The organic light-emitting element OLED may include an anode that is connected to a third node N3 via the second emission control transistor ET2 and a cathode that receives the second power voltage ELVSS. The storage capacitor CST may include a first terminal that receives the first power voltage ELVDD and a second terminal that is connected to a first node N1. The driving transistor DT may include a gate terminal that is connected to the first node N1, a first terminal that is connected to a second node N2, and a second terminal that is connected to the third node N3. The switching transistor ST may include a gate terminal that receives a second gate signal GW2, a first terminal that is connected to a data line that transfers a data signal DS, and a second terminal that is connected to the second node N2. The first emission control transistor ET1 may include a gate terminal that receives the emission control signal EM, a first terminal that receives the first power voltage ELVDD, and a second terminal that is connected to the second node N2. The second emission control transistor ET2 may include a gate terminal that receives the emission control signal EM, a first terminal that is connected to the third node N3, and a second terminal that is connected to the anode of the organic light-emitting element OLED. Although it is illustrated in FIG. 2 that the first emission control transistor ET1 and the second emission control transistor ET2 are controlled by one emission control signal EM, in some embodiments, the first emission control transistor ET1 and the second emission control transistor ET2 may be controlled by respective independent emission control signals. In an embodiment, the first emission control transistor ET1 may be controlled by a first emission control signal, and the second emission control transistor ET2 may be controlled by a second emission control signal that is delayed from the first emission control signal by a predetermined time, for example. In some embodiments, the main circuit 120 may include only one of the first emission control transistor ET1 and the second emission control transistor ET2.

The sub circuit 140 may include a first compensation transistor CT1 and a second compensation transistor CT2 that are connected in series between the first node N1 and the third node N3. In an embodiment, as illustrated in FIG. 2, the sub circuit 140 may include the first compensation transistor CT1, the second compensation transistor CT2, an initialization transistor IT, and a bypass transistor BT, for example. The first compensation transistor CT1 may include a gate terminal that receives the first gate signal GW1, a first terminal that is connected to the first node N1, and a second terminal that is connected to the fourth node N4. The second compensation transistor CT2 may include a gate terminal that receives the second gate signal GW2, a first terminal that is connected to the fourth node N4, and a second terminal that is connected to the third node N3. The initialization transistor IT may include a gate terminal that receives an initialization signal GI, a first terminal that is connected to the first node N1, and a second terminal that receives an initialization voltage VINT. The bypass transistor BT may include a gate terminal that receives a bypass signal BI, a first terminal that receives the initialization voltage VINT, and a second terminal that is connected to the anode of the organic light-emitting element OLED. In some embodiments, the initialization signal GI that controls the initialization transistor IT may be the same as the bypass signal BI that controls the bypass transistor BT. Here, in a low-frequency driving mode (e.g., 30 Hz driving mode) of the organic light-emitting display device, a driving frequency of the first gate signal GW1 may be N hertz (Hz), which is a driving frequency of the organic light-emitting display device, where N is a positive integer, a driving frequency of the initialization signal GI may be N Hz, and a driving frequency of the second gate signal GW2 may be M Hz, where M is a positive integer and different from N. Thus, in the low-frequency driving mode of the organic light-emitting display device, the first compensation transistor CT1 that is controlled by the first gate signal GW1 may be turned on during a first time duration in N non-light-emitting periods IP+CWP per second, the initialization transistor IT that is controlled by the initialization signal GI may be turned on during the first time duration in N non-light-emitting periods IP+CWP per second, and the second compensation transistor CT2 that is controlled by the second gate signal GW2 may be turned on during a second time duration in M non-light-emitting periods IP+CWP per second. In some embodiments, in the low-frequency driving mode of the organic light-emitting display device, a driving frequency of the bypass signal BI may be N Hz. Thus, the bypass transistor BT that is controlled by the bypass signal BI may also be turned on during the first time duration in N non-light-emitting periods IP+CWP per second. Here, the first time duration may be longer than the second time duration or equal to the second time duration.

In an embodiment, in the low-frequency driving mode of the organic light-emitting display device, the driving frequency of the first gate signal GW1 and the driving frequency of the initialization signal GI may be lower than the driving frequency of the second gate signal GW2. In an embodiment, when the driving frequency of the organic light-emitting display device is 30 Hz, the driving frequency of the first gate signal GW1 may be 30 Hz that is the driving frequency of the organic light-emitting display device, the driving frequency of the initialization signal GI may be 30 Hz that is the driving frequency of the organic light-emitting display device, and the driving frequency of the second gate signal GW2 may be 60 Hz that is higher than the driving frequency of the organic light-emitting display device, for example. In this case, the first compensation transistor CT1 that is controlled by the first gate signal GW1 may be turned on during the first time duration in 30 non-light-emitting periods IP+CWP per second, the initialization transistor IT that is controlled by the initialization signal GI may be turned on during the first time duration in 30 non-light-emitting periods IP+CWP per second, and the second compensation transistor CT2 that is controlled by the second gate signal GW2 may be turned on during the second time duration in 60 non-light-emitting periods IP+CWP per second. In an embodiment, the initialization transistor IT, the first compensation transistor CT1, and the second compensation transistor CT2 may be turned on and then off in a non-light-emitting period IP+CWP of a first image frame, and only the second compensation transistor CT2 may be turned on and then off in a non-light-emitting period IP+CWP of a second image frame following the first image frame, for example. These operations will be described below with reference to FIGS. 4 to 6. Because the first gate signal GW1 and the second gate signal GW2 need to have different driving frequencies in the low-frequency driving mode of the organic light-emitting display device, the first gate signal GW1 and the second gate signal GW2 may be generated by respective independent signal generating circuits. In an embodiment, the initialization signal GI may be generated independently of the first gate signal GW1 and the second gate signal GW2 (e.g., the initialization signal GI may be generated by an initialization signal generating circuit). In another embodiment, the initialization signal GI may be replaced by a first gate signal GW1 that is applied to an adjacent gate line (or referred to as an adjacent horizontal line).

As described above, the pixel circuit 100 may sequentially perform the non-light-emitting period (i.e., the initializing period IP and the threshold voltage compensating and data writing period CWP) and the light-emitting period EP in each image frame IF(k), IF(k+1), and IF(k+2). In an embodiment, in the initializing period IP, the initialization transistor IT and the bypass transistor BT may be turned on, and thus the initialization voltage VINT (e.g., −4V) may be applied to the first node N1 (i.e., the gate terminal of the driving transistor DT) and the anode of the organic light-emitting element OLED, for example. Thus, the gate terminal of the driving transistor DT and the anode of the organic light-emitting element OLED may be initialized with the initialization voltage VINT. In the threshold voltage compensating and data writing period CWP, the switching transistor ST, the driving transistor DT, the first compensation transistor CT1, and the second compensation transistor CT2 may be turned on, and thus the data signal DS compensated for the threshold voltage of the driving transistor DT may be stored in the storage capacitor CST. In the light-emitting period EP, the first emission control transistor ET1, the second emission control transistor ET2, and the driving transistor DT may be turned on, and thus the driving current corresponding to the data signal DS stored in the storage capacitor CST may flow into the organic light-emitting element OLED. Here, because the driving current corresponding to the data signal DS needs to flow only into the organic light-emitting element OLED, the switching transistor ST, the bypass transistor BT, the first compensation transistor CT1, the second compensation transistor CT2, and the initialization transistor IT may be turned off. However, because the fourth node N4 between the first compensation transistor CT1 and the second compensation transistor CT2 becomes in a floating state after the first compensation transistor CT1, the second compensation transistor CT2, and the initialization transistor IT are turned on and then off in the non-light-emitting period IP+CWP, a voltage of the fourth node N4 may increase to a voltage corresponding to the turn-off voltage (e.g., 7.6 volts (V)) of the gate signal that is applied to the first compensation transistor CT1 and the second compensation transistor CT2 when the fourth node N4 is maintained in the floating state. Thus, a leakage current may flow from the fourth node N4 to the first node N1 through the first compensation transistor CT1 because the voltage of the fourth node N4 is substantially higher than the voltage of the first node N1. In addition, when the voltage of the first node N1 increases as the leakage current flows into the first node N1, the leakage current may flow from the first node N1 to a supplying terminal of the initialization voltage VINT through the initialization transistor IT. That is, the voltage of the first node N1 may be changed (i.e., the voltage of the gate terminal of the driving transistor DT may be changed) when the fourth node N4 between the first compensation transistor CT1 and the second compensation transistor CT2 becomes in the floating state, and thus a flicker that a viewer recognizes may occur because the driving current flowing into the organic light-emitting element OLED may be changed. When the organic light-emitting display device is driven at a relatively high frequency, the image quality deterioration due to the flicker may not be severe because a time during which the leakage current flows is short. When the organic light-emitting display device is driven at a relatively low frequency (i.e., in a low-frequency driving mode of the organic light-emitting display device), the image quality deterioration due to the flicker may be severe because the time during which the leakage current flows is long.

Therefore, the pixel circuit 100 may have a structure in which the first compensation transistor CT1 and the second compensation transistor CT2 are connected in series between the gate terminal of the driving transistor DT (i.e., the first node N1) and one terminal of the driving transistor DT (i.e., the third node N3), where one terminal of the first compensation transistor CT1 is connected to the gate terminal of the driving transistor DT and one terminal of the second compensation transistor CT2 is connected to one terminal of the driving transistor DT. In the low-frequency driving mode of the organic light-emitting display device, the pixel circuit 100 may turn on the first compensation transistor CT1 and the initialization transistor IT during the first time duration in N non-light-emitting periods IP+CWP per second (i.e., the driving frequency of the first gate signal GW1 that controls the first compensation transistor CT1 and the driving frequency of the initialization signal GI that controls the initialization transistor IT may be N Hz, which is the driving frequency of the organic light-emitting display device) and may turn on the second compensation transistor CT2 during the second time duration in M non-light-emitting periods IP+CWP per second, where M is an integer greater than N (i.e., the driving frequency of the second gate signal GW2 that controls the second compensation transistor CT2 may be M Hz). Hence, when the organic light-emitting display device operates in the low-frequency driving mode, in some non-light-emitting periods IP+CWP, the second compensation transistor CT2 may be turned on by the second gate signal GW2, the switching transistor ST may be turned on by the second gate signal GW2, and thus a predetermined voltage corresponding to the data signal DS may be applied to the fourth node N4 through the switching transistor ST, the driving transistor DT, and the second compensation transistor CT2. In other words, when the organic light-emitting display device operates in the low-frequency driving mode, in some non-light-emitting periods IP+CWP, the fourth node N4 between the first compensation transistor CT1 and the second compensation transistor CT2 may be out of the floating state because the switching transistor ST and the second compensation transistor CT2 are turned on. As a result, when the organic light-emitting display device operates in the low-frequency driving mode, in some non-light-emitting periods IP+CWP, the pixel circuit 100 may allow the fourth node N4 between the first compensation transistor CT1 and the second compensation transistor CT2 to be out of the floating state and thus may minimize (or reduce) the leakage current flowing through the first compensation transistor CT1 and the initialization transistor IT to prevent the flicker that the viewer recognizes from occurring (i.e., prevent the voltage of the gate terminal of the driving transistor DT from being changed).

Figure 4:
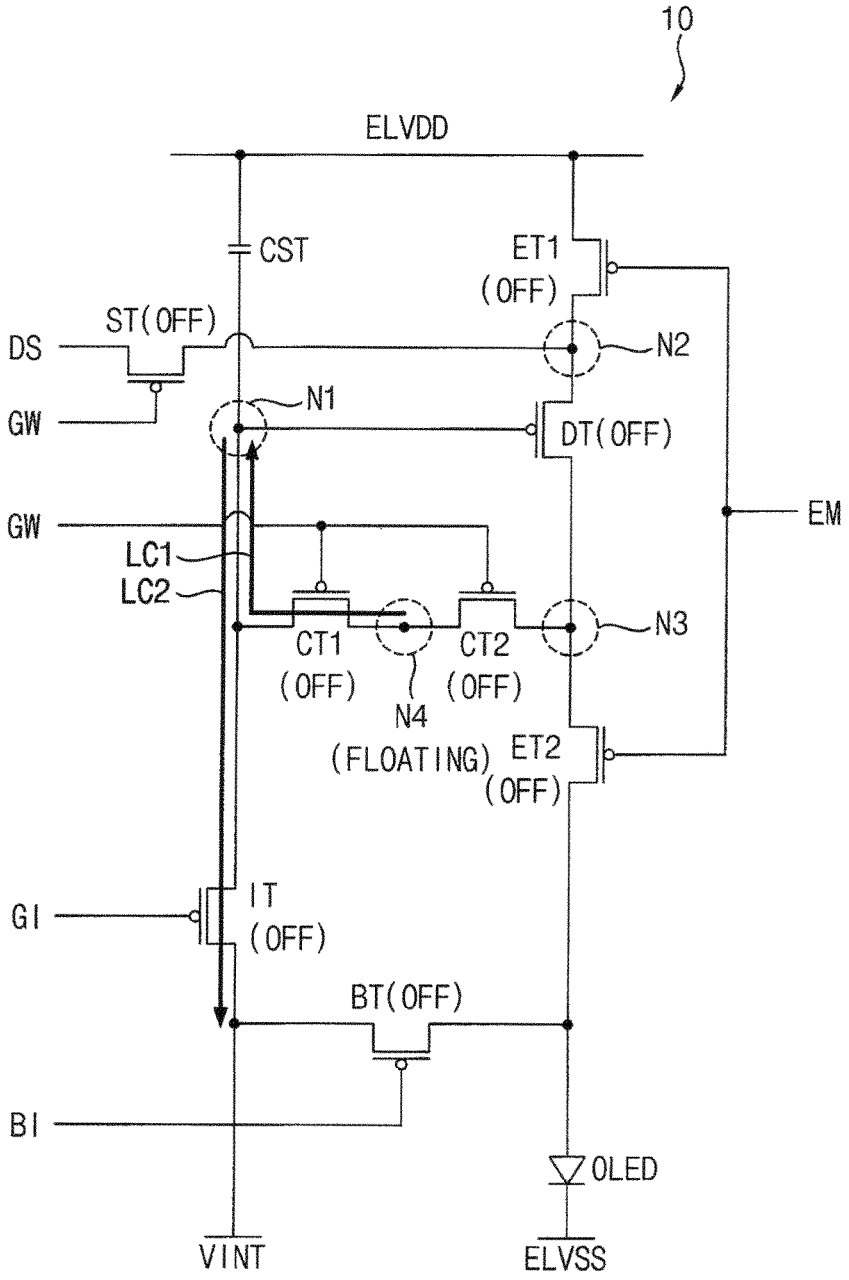
FIG. 4 (PRIOR ART)
FIG. 4 is a diagram for describing that a leakage current flows as a fourth node is floated in a conventional pixel circuit.
Figure 5:
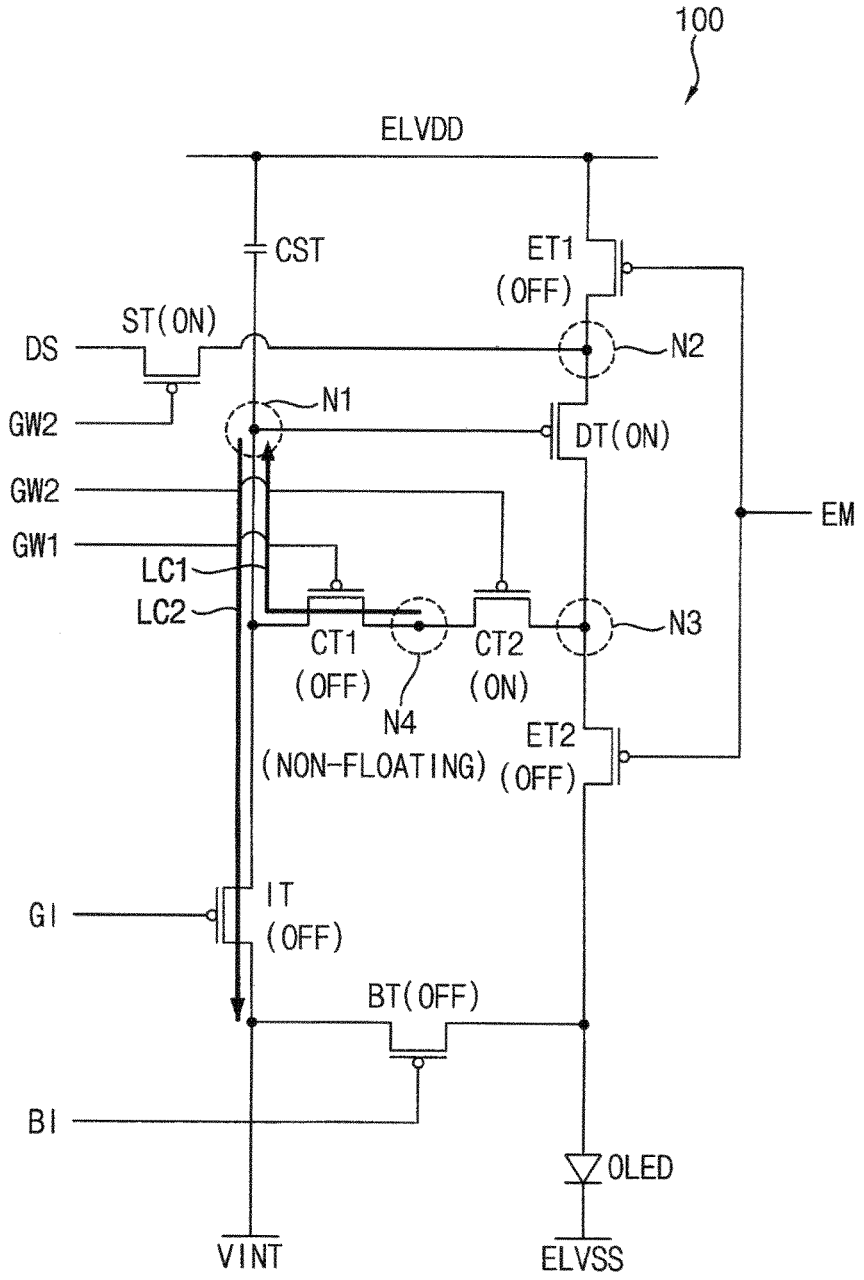
FIG. 5 is a diagram for describing that a leakage current is reduced as a fourth node is not floated in the pixel circuit of FIG. 2.

FIG. 4 is a diagram for describing that a leakage current flows as a fourth node is floated in a conventional pixel circuit, and FIG. 5 is a diagram for describing that a leakage current is reduced as a fourth node is not floated in the pixel circuit of FIG. 2.

Referring to FIGS. 4 and 5, when the organic light-emitting display device operates in the low-frequency driving mode, the pixel circuit 100 may minimize (or reduce) the leakage currents LC1 and LC2 flowing through the first compensation transistor CT1 and the initialization transistor IT in some non-light-emitting periods IP+CWP as compared to a conventional pixel circuit 10. For convenience of description, it is assumed below that the turn-off voltage of the gate signals GW, GW1, and GW2 is 7.6V, the turn-off voltage of the initialization signal GI is 7.6V, and the initialization voltage VINT is −4V.

As described above, the pixel circuit 100 may minimize (or reduce) the leakage currents LC1 and LC2 flowing through the first compensation transistor CT1 and the initialization transistor IT in some non-light-emitting periods IP+CWP by controlling the first compensation transistor CT1 and the second compensation transistor CT2 with the first gate signal GW1 and the second gate signal GW2 having different driving frequencies, respectively. Specifically, in the conventional pixel circuit 10 and the pixel circuit 100, during a normal non-light-emitting period IP+CWP in which the initializing operation and the threshold voltage compensating and data writing operation are performed, the first compensation transistor CT1 and the second compensation transistor CT2 may be turned on and then off (i.e., the threshold voltage compensating and data writing operation for storing the data signal DS compensated for the threshold voltage of the driving transistor DT in the storage capacitor CST is performed) after the initialization transistor IT is turned on and then off (i.e., the initializing operation for initializing the first node N1 is performed).

As illustrated in FIG. 4, in the conventional pixel circuit 10, during a hold non-light-emitting period IP+CWP in which the initializing operation and the threshold voltage compensating and data writing operation are not performed, the first compensation transistor CT1, the second compensation transistor CT2, and the initialization transistor IT may be turned off. In other words, in the conventional pixel circuit 10, during the hold non-light-emitting period IP+CWP in which the initializing operation and the threshold voltage compensating and data writing operation are not performed, the switching transistor ST, the driving transistor DT, the first compensation transistor CT1, the second compensation transistor CT2, the first emission control transistor ET1, the second emission control transistor ET2, the initialization transistor IT, and the bypass transistor BT may be turned off (i.e., indicated by ST(OFF), DT(OFF), CT1(OFF), CT2(OFF), ET1(OFF), ET2(OFF), IT(OFF), and BT(OFF)). Here, because the first compensation transistor CT1 and the second compensation transistor CT2 are turned off, the fourth node N4 between the first compensation transistor CT1 and the second compensation transistor CT2 may become in the floating state (i.e., indicated by N4(FLOATING)). Thus, since the gate signal GW that is applied to the gate terminal of the first compensation transistor CT1 and the gate terminal of the second compensation transistor CT2 has the turn-off voltage of 7.6V, the fourth node N4 between the first compensation transistor CT1 and the second compensation transistor CT2 may have a voltage of about 7.6V due to the influence of the gate signal GW. As a result, since the voltage of the fourth node N4 is 7.6V and the voltage of the first node N1 is a voltage corresponding to the data signal DS (e.g., 0.63V for the 31st gray-level, −0.03V for the 87th gray-level, −0.7V for the 255th gray-level, etc.), the first leakage current LC1 may flow from the fourth node N4 to the first node N1 through the first compensation transistor CT1. Subsequently, when the voltage of the first node N1 increases as the first leakage current LC1 flows, the second leakage current LC2 may flow from the first node N1 to the supplying terminal of the initialization voltage VINT through the initialization transistor IT. In brief, in the conventional pixel circuit 10, during the hold non-light-emitting period IP+CWP in which the initializing operation and the threshold voltage compensating and data writing operation are not performed, the voltage of the gate terminal of the driving transistor DT (i.e., the first node N1) may be changed due to the leakage currents LC1 and LC2 flowing through the first compensation transistor CT1 and the initialization transistor IT, and thus the flicker that the viewer recognizes may occur as light-emitting luminance of the organic light-emitting element OLED is changed.

As illustrated in FIG. 5, in the pixel circuit 100, during the hold non-light-emitting period IP+CWP in which the initializing operation and the threshold voltage compensating and data writing operation are not performed, the first compensation transistor CT1 and the initialization transistor IT may be turned off, but the second compensation transistor CT2 may be turned on and then off (i.e., the second compensation transistor CT2 may be turned on during the second time duration). In other words, in the pixel circuit 100, during the hold non-light-emitting period IP+CWP in which the initializing operation and the threshold voltage compensating and data writing operation are not performed, the switching transistor ST, the driving transistor DT, and the second compensation transistor CT2 may be turned on (i.e., indicated by ST(ON), DT(ON), and CT2(ON)), and the first compensation transistor CT1, the first emission control transistor ET1, the second emission control transistor ET2, the initialization transistor IT, and the bypass transistor BT may be turned off (i.e., indicated by CT1(OFF), ET1(OFF), ET2(OFF), IT(OFF), and BT(OFF)). Here, because the switching transistor ST, the driving transistor DT, and the second compensation transistor CT2 are turned on, a predetermined voltage corresponding to the data signal DS may be applied to the fourth node N4 through the switching transistor ST, the driving transistor DT, and the second compensation transistor CT2. Thus, in the pixel circuit 100, during the hold non-light-emitting period IP+CWP in which the initializing operation and the threshold voltage compensating and data writing operation are not performed, the fourth node N4 between the first compensation transistor CT1 and the second compensation transistor CT2 may be out of the floating state (i.e., indicated by N4(NON FLOATING)). That is, as the fourth node N4 between the first compensation transistor CT1 and the second compensation transistor CT2 has a voltage corresponding to the data signal DS (e.g., 0.63V for the 31st gray-level, −0.03V for the 87th gray-level, −0.7V for the 255th gray-level, etc.), the first leakage current LC1 may decrease. In addition, as the first leakage current LC1 decreases, the second leakage current LC2 may also decrease. In brief, in the pixel circuit 100, during the hold non-light-emitting period IP+CWP in which the initializing operation and the threshold voltage compensating and data writing operation are not performed, a change in the voltage of the gate terminal of the driving transistor DT may be prevented, and thus the recognizable flicker due to the leakage currents LC1 and LC2 flowing through the first compensation transistor CT1 and the initialization transistor IT may be prevented (or reduced).

Figure 6:
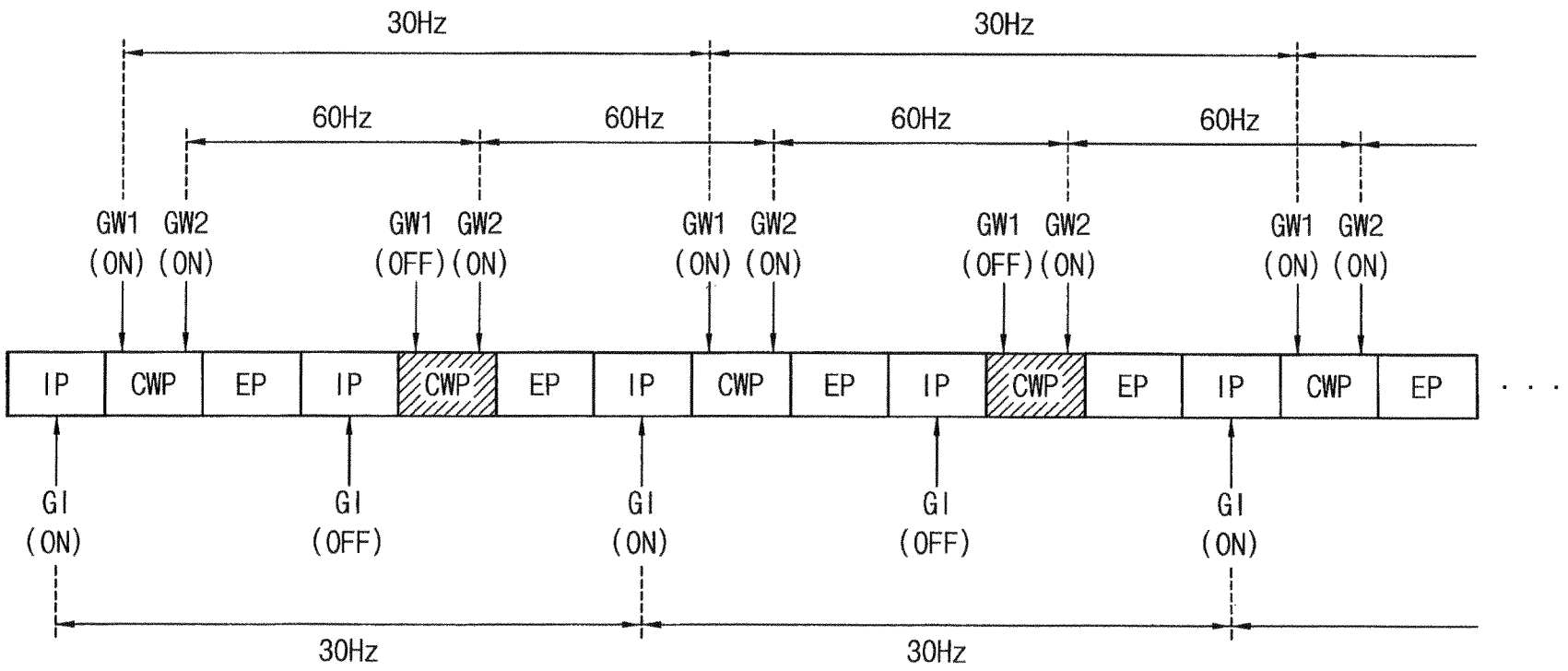
FIG. 6 is a diagram for describing that the pixel circuit of FIG. 2 operates in a low-frequency driving mode.
Figure 7:
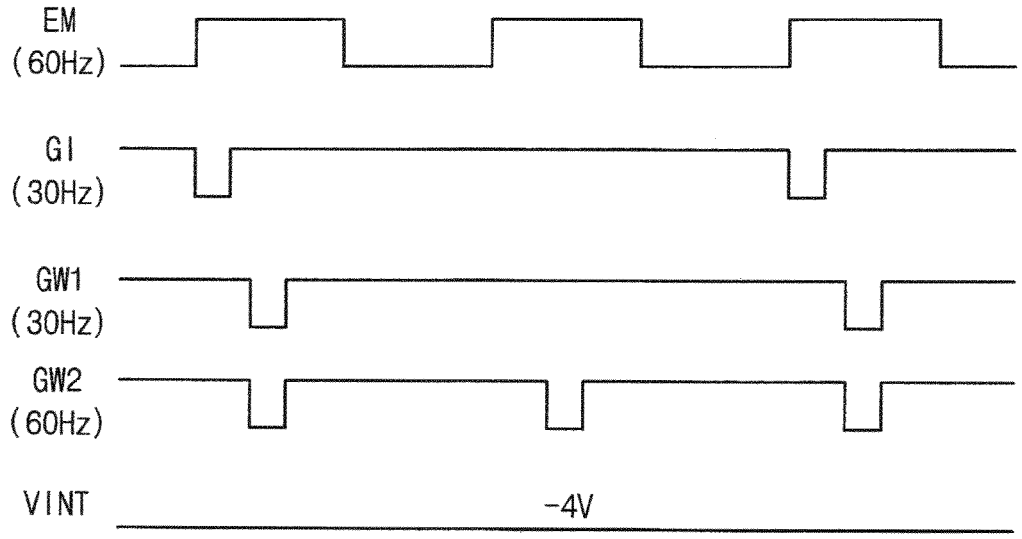
FIG. 7 is a diagram illustrating an example in which the pixel circuit of FIG. 2 operates in a low-frequency driving mode.

FIG. 6 is a diagram for describing that the pixel circuit of FIG. 2 operates in a low-frequency driving mode, and FIG. 7 is a diagram illustrating an example in which the pixel circuit of FIG. 2 operates in a low-frequency driving mode.

Referring to FIGS. 6 and 7, in the low-frequency driving mode of the organic light-emitting display device, the pixel circuit 100 may sequentially perform the initializing period IP, the threshold voltage compensating and data writing period CWP, and the light-emitting period EP in each image frame. As described above, in the low-frequency driving mode of the organic light-emitting display device, the driving frequency of the first gate signal GW1 may be N Hz, which is the driving frequency of the organic light-emitting display device, the driving frequency of the initialization signal GI may be N Hz, which is the driving frequency of the organic light-emitting display device, and the driving frequency of the second gate signal GW2 may be M Hz, which is higher than the driving frequency of the organic light-emitting display device. In an embodiment, the driving frequency of the emission control signal EM may be equal to the driving frequency of the second gate signal GW2. Thus, the first compensation transistor CT1 that is controlled by the first gate signal GW1 may be turned on during the first time duration in N non-light-emitting periods IP+CWP per second, the initialization transistor IT that is controlled by the initialization signal GI may be turned on during the first time duration in N non-light-emitting periods IP+CWP per second, and the second compensation transistor CT2 that is controlled by the second gate signal GW2 may be turned on during the second time duration in M non-light-emitting periods IP+CWP per second. For convenience of description, it is assumed below that the driving frequency of the organic light-emitting display device is 30 Hz, the driving frequency of the first gate signal GW1 is 30 Hz, the driving frequency of the second gate signal GW2 is 60 Hz, the driving frequency of the initialization signal GI is 30 Hz, the first compensation transistor CT1 that is controlled by the first gate signal GW1 is turned on during the first time duration in 30 non-light-emitting periods IP+CWP per second, the second compensation transistor CT2 that is controlled by the second gate signal GW2 is turned on during the second time duration in 60 non-light-emitting periods IP+CWP per second, the initialization transistor IT that is controlled by the initialization signal GI is turned on during the first time duration in 30 non-light-emitting periods IP+CWP per second, and the first time duration is equal to the second time duration (i.e., a turn-on voltage level period of the second gate signal GW2 is consistent with a turn-on voltage level period of the first gate signal GW1).

In the non-light-emitting period IP+CWP of the first image frame (i.e., the normal non-light-emitting period in which the initializing operation and the threshold voltage compensating and data writing operation are performed), the first gate signal GW1 and the initialization signal GI may have the turn-on voltage level during the first time duration, and the second gate signal GW2 may have the turn-on voltage level during the second time duration (i.e., indicated by GW1(ON), GW2(ON), and GI(ON)). Specifically, as illustrated in FIGS. 2, 6 and 7, in the non-light-emitting period IP+CWP of the first image frame, the first emission control transistor ET1 and the second emission control transistor ET2 may be turned off by the emission control signal EM. In the initializing period IP of the first image frame, the initialization transistor IT may be turned on and then off by the initialization signal GI. In the threshold voltage compensating and data writing period CWP of the first image frame, the first compensation transistor CT1 and the second compensation transistor CT2 may be turned on and then off by the first gate signal GW1 and the second gate signal GW2. Subsequently, in the light-emitting period EP of the first image frame, the first emission control transistor ET1 and the second emission control transistor ET2 may be turned on by the emission control signal EM. Next, in the non-light-emitting period IP+CWP of the second image frame following the first image frame (i.e., the hold non-light-emitting period in which the initializing operation and the threshold voltage compensating and data writing operation are not performed), the first gate signal GW1 and the initialization signal GI may have the turn-off voltage level, and only the second gate signal GW2 may have the turn-on voltage level during the second time duration (i.e., indicated by GW1(OFF), GW2(ON), and GI(OFF) in FIG. 6). Specifically, as illustrated in FIGS. 2, 6 and 7, in the non-light-emitting period IP+CWP of the second image frame, the first emission control transistor ET1 and the second emission control transistor ET2 may be turned off by the emission control signal EM. In the initializing period IP of the second image frame, the initialization transistor IT may be maintained in the turn-off state by the initialization signal GI. In the threshold voltage compensating and data writing period CWP of the second image frame, the first compensation transistor CT1 may be maintained in the turn-off state by the first gate signal GW1. However, in the threshold voltage compensating and data writing period CWP of the second image frame, the second compensation transistor CT2 may be turned on and then off by the second gate signal GW2. As a result, as described with reference to FIG. 5, in the non-light-emitting period IP+CWP of the second image frame, the leakage currents LC1 and LC2 flowing through the first compensation transistor CT1 and the initialization transistor IT may be reduced.

Next, in the non-light-emitting period IP+CWP of the third image frame following the second image frame (i.e., the normal non-light-emitting period in which the initializing operation and the threshold voltage compensating and data writing operation are performed), the first gate signal GW1 and the initialization signal GI may have the turn-on voltage level during the first time duration, and the second gate signal GW2 may have the turn-on voltage level during the second time duration (i.e., indicated by GW1(ON), GW2(ON), and GI(ON)). Specifically, as illustrated in FIGS. 2, 6 and 7, in the non-light-emitting period IP+CWP of the third image frame, the first emission control transistor ET1 and the second emission control transistor ET2 may be turned off by the emission control signal EM. In the initializing period IP of the third image frame, the initialization transistor IT may be turned on and then off by the initialization signal GI. In the threshold voltage compensating and data writing period CWP of the third image frame, the first compensation transistor CT1 and the second compensation transistor CT2 may be turned on and then off by the first gate signal GW1 and the second gate signal GW2. Subsequently, in the light-emitting period EP of the third image frame, the first emission control transistor ET1 and the second emission control transistor ET2 may be turned on by the emission control signal EM. Next, in the non-light-emitting period IP+CWP of the fourth image frame following the third image frame (i.e., the hold non-light-emitting period in which the initializing operation and the threshold voltage compensating and data writing operation are not performed), the first gate signal GW1 and the initialization signal GI may have the turn-off voltage level, and only the second gate signal GW2 may have the turn-on voltage level during the second time duration (i.e., indicated by GW1(OFF), GW2(ON), and GI(OFF)). Specifically, as illustrated in FIGS. 2, 6 and 7, in the non-light-emitting period IP+CWP of the fourth image frame, the first emission control transistor ET1 and the second emission control transistor ET2 may be turned off by the emission control signal EM. In the initializing period IP of the fourth image frame, the initialization transistor IT may be maintained in the turn-off state by the initialization signal GI. In the threshold voltage compensating and data writing period CWP of the fourth image frame, the first compensation transistor CT1 may be maintained in the turn-off state by the first gate signal GW1. However, in the threshold voltage compensating and data writing period CWP of the fourth image frame, the second compensation transistor CT2 may be turned on and then off by the second gate signal GW2. As a result, as described with reference to FIG. 5, in the non-light-emitting period IP+CWP of the fourth image frame, the leakage currents LC1 and LC2 flowing through the first compensation transistor CT1 and the initialization transistor IT may be reduced.

In this manner, the first compensation transistor CT1 may be turned on for the first time duration in 30 non-light-emitting periods IP+CWP per second, the second compensation transistor CT2 may be turned on for the second time duration in 60 non-light-emitting periods IP+CWP per second, and the initialization transistor IT may be turned on for the first time duration in 30 non-light-emitting periods IP+CWP per second. To this end, the first gate signal GW1 that controls the first compensation transistor CT1 may be generated to have the driving frequency of 30 Hz (i.e., indicated by 30 Hz), the second gate signal GW2 that controls the second compensation transistor CT2 may be generated to have the driving frequency of 60 Hz (i.e., indicated by 60 Hz), and the initialization signal GI that controls the initialization transistor IT may be generated to have the driving frequency of 30 Hz (i.e., indicated by 30 Hz). Because the first gate signal GW1 that controls the first compensation transistor CT1 and the second gate signal GW2 that controls the second compensation transistor CT2 have different driving frequencies, the first gate signal GW1 and the second gate signal may be generated, respectively by respective signal generating circuits that are independent of each other. Although it is described above that the driving frequency of the organic light-emitting display device is 30 Hz (i.e., the low-frequency driving mode of the organic light-emitting display device), the driving frequency of the first gate signal GW1 is 30 Hz, the driving frequency of the second gate signal GW2 is 60 Hz, and the driving frequency of the initialization signal GI is 30 Hz, the invention is not limited thereto. In an embodiment, it should be understood that the driving frequency of the first gate signal GW1, the driving frequency of the second gate signal GW2, and the driving frequency of the initialization signal GI may be variously set according to the driving frequency of the organic light-emitting display device, for example.

Figure 8:
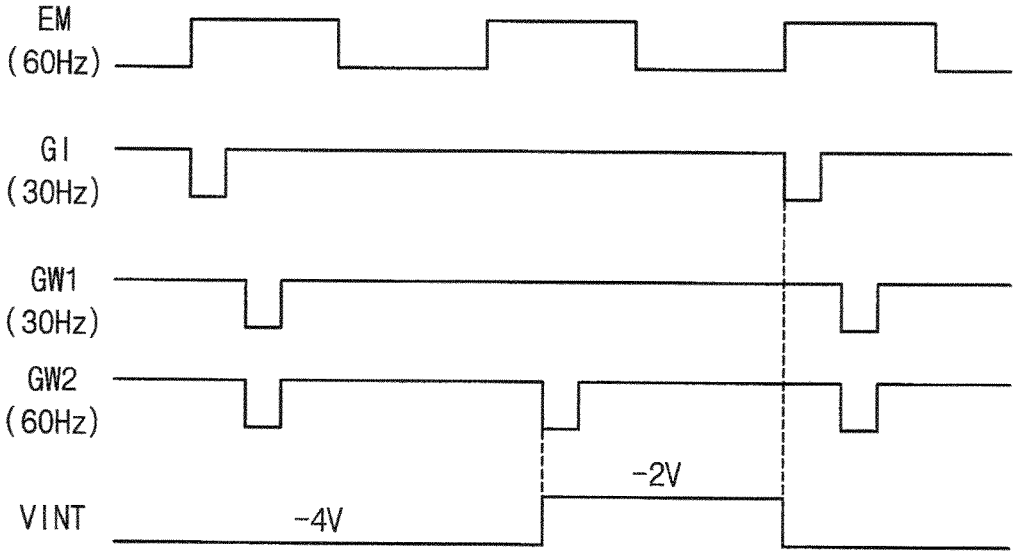
FIG. 8 is a diagram illustrating another example in which the pixel circuit of FIG. 2 operates in a low-frequency driving mode.

FIG. 8 is a diagram illustrating another example in which the pixel circuit of FIG. 2 operates in a low-frequency driving mode.

Referring to FIG. 8, in the low-frequency driving mode of the organic light-emitting display device, the driving frequency of the first gate signal GW1 may be N Hz (e.g., 30 Hz), which is the driving frequency of the organic light-emitting display device, the driving frequency of the initialization signal GI may be N Hz, which is the driving frequency of the organic light-emitting display device, and the driving frequency of the second gate signal GW2 may be M Hz (e.g., 60 Hz), which is higher than the driving frequency of the organic light-emitting display device. In an embodiment, the driving frequency of the emission control signal EM may be equal to the driving frequency of the second gate signal GW2. Except that the initialization voltage VINT is changed in the low-frequency driving mode of the organic light-emitting display device, an operation of the pixel circuit of FIG. 2 illustrated in FIG. 8 is the same as that of the pixel circuit of FIG. 2 described with reference to FIGS. 6 and 7. Thus, duplicated description therebetween will not be repeated. As described above, the first compensation transistor CT1 that is controlled by the first gate signal GW1 may be turned on during the first time duration in N non-light-emitting periods IP+CWP per second, the initialization transistor IT that is controlled by the initialization signal GI may be turned on during the first time duration in N non-light-emitting periods IP+CWP per second, and the second compensation transistor CT2 that is controlled by the second gate signal GW2 may be turned on during the second time duration in M non-light-emitting periods IP+CWP per second. Here, the initialization voltage VINT may be changed from a first voltage level (e.g., illustrated as −4V) to a second voltage level (e.g., illustrated as −2V) that is higher than the first voltage level at a start point of the hold non-light-emitting period IP+CWP of an image frame, and the initialization voltage VINT may be reset to the first voltage level at a start point of the normal non-light-emitting period IP+CWP of the image frame. Thus, a voltage difference between the voltage of the first node N1 and the initialization voltage VINT may decrease as the initialization voltage VINT increases (e.g., from −4V to −2V) in the hold non-light-emitting period IP+CWP of the image frame. Hence, the second leakage current LC2 flowing from the first node N1 to the supplying terminal of the initialization voltage VINT through the initialization transistor IT may be reduced. As a result, a change in the voltage of the first node N1 may be further prevented in the hold non-light-emitting period IP+CWP of the image frame. In some embodiments, the initialization voltage VINT may be adjusted to be higher than the voltage of the first node N1 so that a direction of the second leakage current LC2 may be changed (i.e., to the opposite direction).

Figure 9:
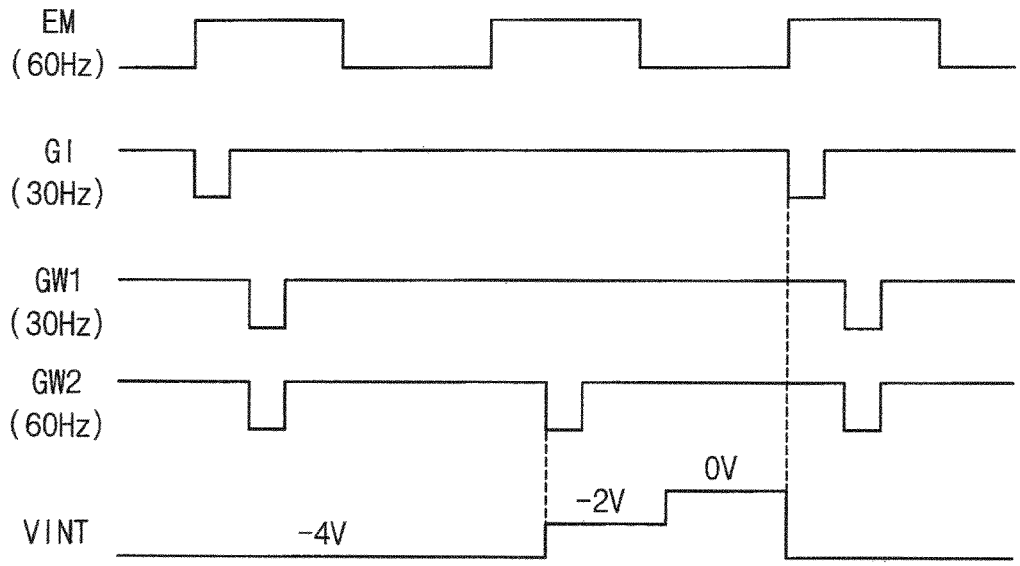
FIG. 9 is a diagram illustrating still another example in which the pixel circuit of FIG. 2 operates in a low-frequency driving mode.

FIG. 9 is a diagram illustrating still another example in which the pixel circuit of FIG. 2 operates in a low-frequency driving mode.

Referring to FIG. 9, in the low-frequency driving mode of the organic light-emitting display device, the driving frequency of the first gate signal GW1 may be N Hz (e.g., 30 Hz), which is the driving frequency of the organic light-emitting display device, the driving frequency of the initialization signal GI may be N Hz, which is the driving frequency of the organic light-emitting display device, and the driving frequency of the second gate signal GW2 may be M Hz (e.g., 60 Hz), which is higher than the driving frequency of the organic light-emitting display device. In an embodiment, the driving frequency of the emission control signal EM may be equal to the driving frequency of the second gate signal GW2. Except that the initialization voltage VINT is changed in the low-frequency driving mode of the organic light-emitting display device, an operation of the pixel circuit of FIG. 2 illustrated in FIG. 9 is the same as that of the pixel circuit of FIG. 2 described with reference to FIGS. 6 and 7. Thus, duplicated description therebetween will not be repeated. As described above, the first compensation transistor CT1 that is controlled by the first gate signal GW1 may be turned on during the first time duration in N non-light-emitting periods IP+CWP per second, the initialization transistor IT that is controlled by the initialization signal GI may be turned on during the first time duration in N non-light-emitting periods IP+CWP per second, and the second compensation transistor CT2 that is controlled by the second gate signal GW2 may be turned on during the second time duration in M non-light-emitting periods IP+CWP per second. Here, the initialization voltage VINT may be changed from a first voltage level (e.g., illustrated as −4V) to a second voltage level (e.g., illustrated as −2V) that is higher than the first voltage level at a start point of the hold non-light-emitting period IP+CWP of an image frame, and the initialization voltage VINT may be reset to the first voltage level at a start point of the normal non-light-emitting period IP+CWP of the image frame. In addition, after the initialization voltage VINT is changed to the second voltage level at the start point of the hold non-light-emitting period IP+CWP of the image frame, the initialization voltage VINT may be further changed to at least one voltage level (e.g., 0V) that is higher than the second voltage level. Thus, a voltage difference between the voltage of the first node N1 and the initialization voltage VINT may decrease as the initialization voltage VINT increases in the hold non-light-emitting period IP+CWP of the image frame. Hence, the second leakage current LC2 flowing from the first node N1 to the supplying terminal of the initialization voltage VINT through the initialization transistor IT may be reduced. As a result, a change in the voltage of the first node N1 may be further prevented in the hold non-light-emitting period IP+CWP of the image frame. In some embodiments, the initialization voltage VINT may be adjusted to be higher than the voltage of the first node N1 so that a direction of the second leakage current LC2 may be changed (i.e., to the opposite direction).

Figure 10:
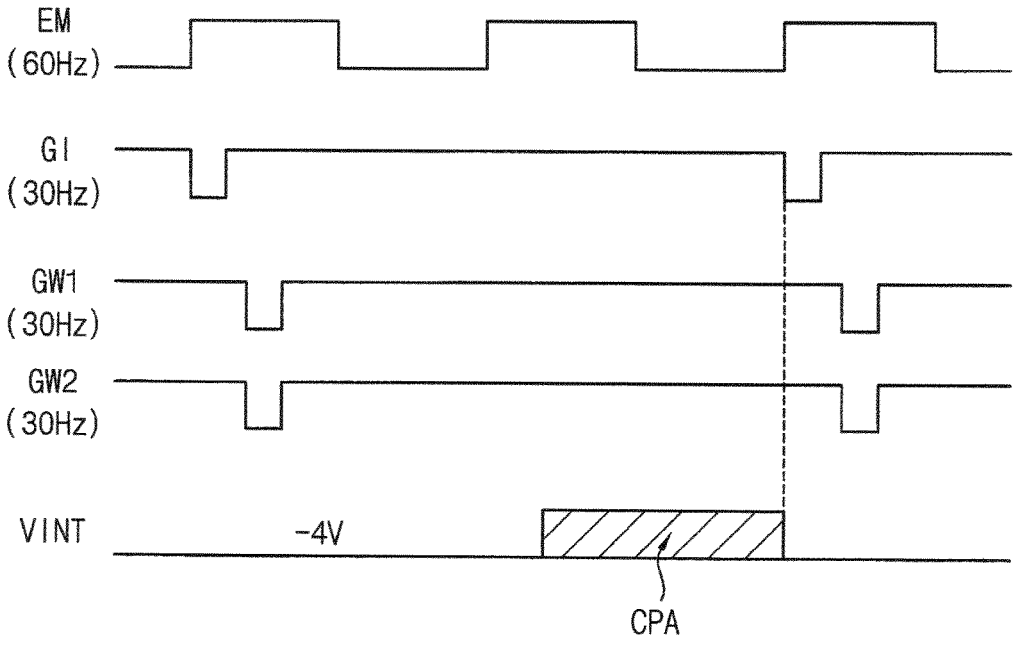
FIG. 10 is a diagram illustrating still another example in which the pixel circuit of FIG. 2 operates in a low-frequency driving mode.

FIG. 10 is a diagram illustrating still another example in which the pixel circuit of FIG. 2 operates in a low-frequency driving mode.

Referring to FIG. 10, in the low-frequency driving mode of the organic light-emitting display device, the driving frequency of the first gate signal GW1 may be N Hz (e.g., 30 Hz), which is the driving frequency of the organic light-emitting display device, the driving frequency of the initialization signal GI may be N Hz, which is the driving frequency of the organic light-emitting display device, and the driving frequency of the second gate signal GW2 may be N Hz (e.g., 30 Hz), which is the driving frequency of the organic light-emitting display device. In an embodiment, the driving frequency of the emission control signal EM may be M Hz (e.g., 60 Hz), which is higher than the driving frequency of the organic light-emitting display device. In this case, because the first compensation transistor CT1 that is controlled by the first gate signal GW1, the initialization transistor IT that is controlled by the initialization signal GI, and the second compensation transistor CT2 that is controlled by the second gate signal GW2 are turned off in the hold non-light-emitting period IP+CWP of an image frame, the second leakage current LC2 flowing from the first node N1 to the supplying terminal of the initialization voltage VINT through the initialization transistor IT may be large. Thus, the initialization voltage VINT may be changed from a first voltage level to a second voltage level that is higher than the first voltage level at a start point (i.e., a start point of CPA) of the hold non-light-emitting period IP+CWP of the image frame, and the initialization voltage VINT may be reset to the first voltage level at a start point (i.e., an end point of CPA) of the normal non-light-emitting period IP+CWP of the image frame. In some embodiments, the initialization voltage VINT may be further changed to at least one voltage level that is higher than the second voltage level after the initialization voltage VINT is changed to the second voltage level at the start point of the hold non-light-emitting period IP+CWP of the image frame. As a result, the second leakage current LC2 flowing from the first node N1 to the supplying terminal of the initialization voltage VINT through the initialization transistor IT may be reduced.

Figure 11:
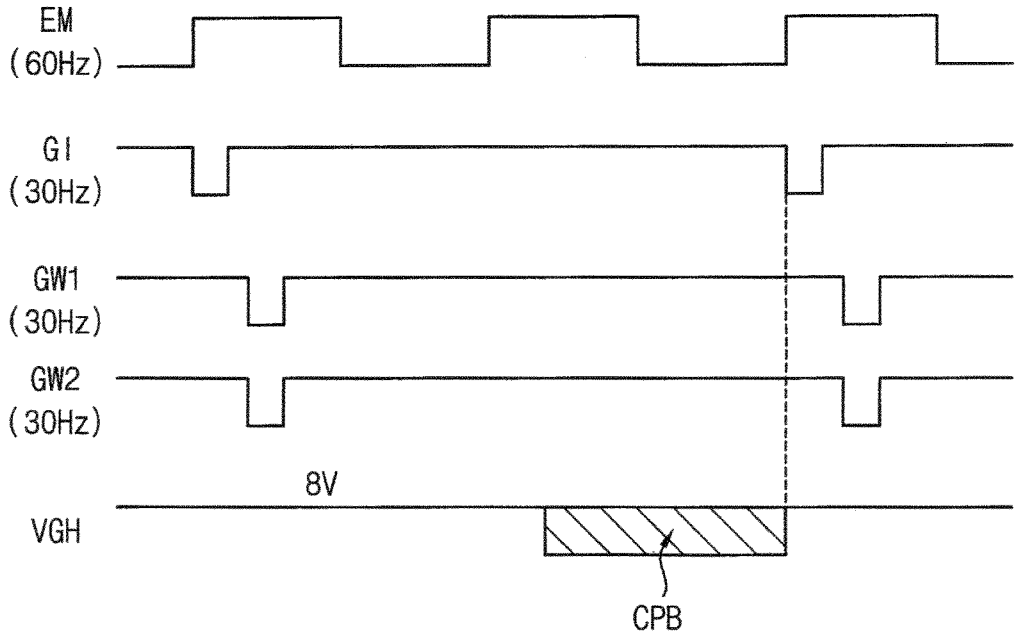
FIG. 11 is a diagram illustrating still another example in which the pixel circuit of FIG. 2 operates in a low-frequency driving mode.

FIG. 11 is a diagram illustrating still another example in which the pixel circuit of FIG. 2 operates in a low-frequency driving mode.

Referring to FIG. 11, in the low-frequency driving mode of the organic light-emitting display device, the driving frequency of the first gate signal GW1 may be N Hz (e.g., 30 Hz), which is the driving frequency of the organic light-emitting display device, the driving frequency of the initialization signal GI may be N Hz, which is the driving frequency of the organic light-emitting display device, and the driving frequency of the second gate signal GW2 may be N Hz (e.g., 30 Hz), which is the driving frequency of the organic light-emitting display device. In an embodiment, the driving frequency of the emission control signal EM may be M Hz (e.g., 60 Hz), which is higher than the driving frequency of the organic light-emitting display device. In this case, because the first compensation transistor CT1 that is controlled by the first gate signal GW1, the initialization transistor IT that is controlled by the initialization signal GI, and the second compensation transistor CT2 that is controlled by the second gate signal GW2 are turned off in the hold non-light-emitting period IP+CWP of an image frame, the first leakage current LC1 flowing from the fourth node N4 to the first node N1 through the first compensation transistor CT1 may be large. Thus, a turn-off voltage level VGH of the first gate signal GW1 and the second gate signal GW2 may be changed from a first voltage level (e.g., illustrated as 8V) to a second voltage level that is lower than the first voltage level at a start point (i.e., a start point of CPB) of the hold non-light-emitting period IP+CWP of the image frame, and the turn-off voltage level VGH of the first gate signal GW1 and the second gate signal GW2 may be reset to the first voltage level at a start point (i.e., an end point of CPB) of the normal non-light-emitting period IP+CWP of the image frame. In some embodiments, the turn-off voltage level VGH of the first gate signal GW1 and the second gate signal GW2 may be further changed to at least one voltage level that is lower than the second voltage level after the turn-off voltage level VGH of the first gate signal GW1 and the second gate signal GW2 is changed to the second voltage level at the start point of the hold non-light-emitting period IP+CWP of the image frame. As a result, the first leakage current LC1 flowing from the fourth node N4 to the first node N1 through the first compensation transistor CT1 may be reduced.

Figure 12:
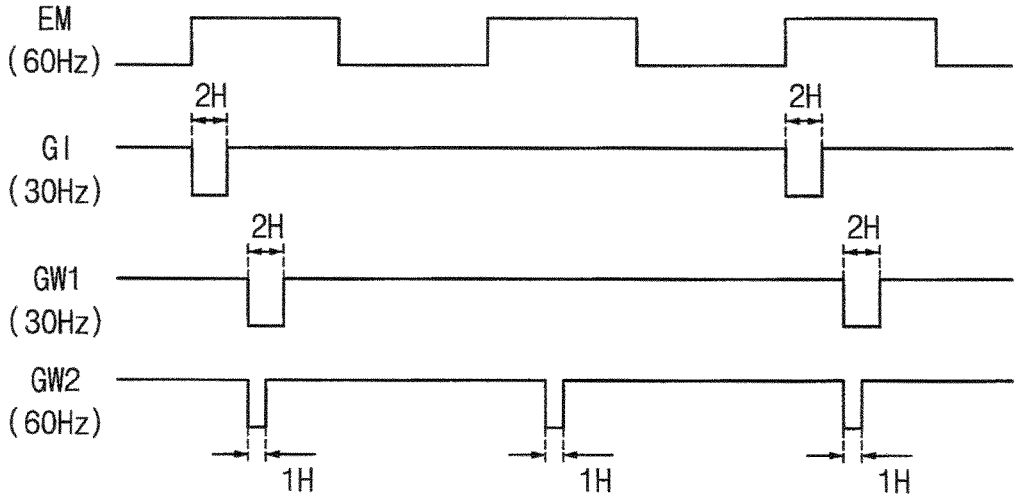
FIG. 12 is a diagram illustrating still another example in which the pixel circuit of FIG. 2 operates in a low-frequency driving mode.

FIG. 12 is a diagram illustrating still another example in which the pixel circuit of FIG. 2 operates in a low-frequency driving mode.

Referring to FIG. 12, in the low-frequency driving mode of the organic light-emitting display device, the driving frequency of the first gate signal GW1 may be N Hz (e.g., 30 Hz), which is the driving frequency of the organic light-emitting display device, the driving frequency of the initialization signal GI may be N Hz, which is the driving frequency of the organic light-emitting display device, and the driving frequency of the second gate signal GW2 may be M Hz (e.g., 60 Hz), which is higher than the driving frequency of the organic light-emitting display device. In an embodiment, the driving frequency of the emission control signal EM may be equal to the driving frequency of the second gate signal GW2. As described above, the first compensation transistor CT1 that is controlled by the first gate signal GW1 may be turned on during the first time duration in N non-light-emitting periods IP+CWP per second, the initialization transistor IT that is controlled by the initialization signal GI may be turned on during the first time duration in N non-light-emitting periods IP+CWP per second, and the second compensation transistor CT2 that is controlled by the second gate signal GW2 may be turned on during the second time duration in M non-light-emitting periods IP+CWP per second. Here, the first time duration (e.g., two horizontal periods 2H) may be longer than the second time duration (e.g., one horizontal time 1H). Thus, the turn-on voltage level period of the first gate signal GW1 corresponding to the first time duration may be longer than the turn-on voltage level period of the second gate signal GW2 corresponding to the second time duration, and thus the turn-on voltage level period of the second gate signal GW2 corresponding to the second time duration may overlap the turn-on voltage level period of the first gate signal GW1 corresponding to the first time duration. In an embodiment, as illustrated in FIG. 12, a start point of the turn-on voltage level period of the second gate signal GW2 may be consistent with a start point of the turn-on voltage level period of the first gate signal GW1, and an end point of the turn-on voltage level period of the second gate signal GW2 may be before (or prior to) an end point of the turn-on voltage level period of the first gate signal GW1. Thus, since a period where the turn-on voltage level period of the first gate signal GW1 and the turn-on voltage level period of the second gate signal GW2 do not overlap exists in the normal non-light-emitting period IP+CWP of an image frame, the fourth node N4 between the first compensation transistor CT1 and the second compensation transistor CT2 may be out of the floating state in the period where the turn-on voltage level period of the first gate signal GW1 and the turn-on voltage level period of the second gate signal GW2 do not overlap. In the hold non-light-emitting period IP+CWP of the image frame, the second compensation transistor CT2 may be turned on during the second time duration, and thus the fourth node N4 between the first compensation transistor CT1 and the second compensation transistor CT2 may be out of the floating state. As a result, the first leakage current LC1 flowing from the fourth node N4 to the first node N1 through the first compensation transistor CT1 may be reduced.

Figure 13:
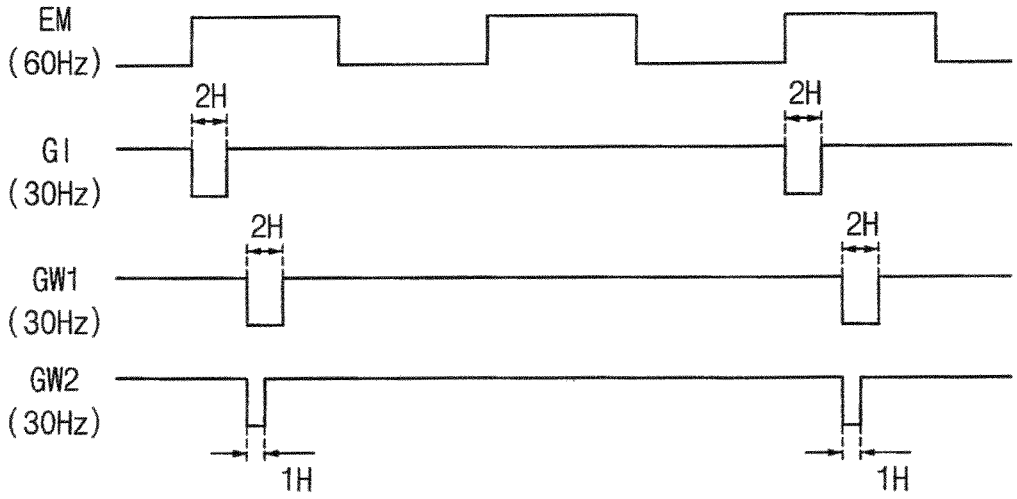
FIG. 13 is a diagram illustrating still another example in which the pixel circuit of FIG. 2 operates in a low-frequency driving mode.

FIG. 13 is a diagram illustrating still another example in which the pixel circuit of FIG. 2 operates in a low-frequency driving mode.

Referring to FIG. 13, in the low-frequency driving mode of the organic light-emitting display device, the driving frequency of the first gate signal GW1 may be N Hz (e.g., 30 Hz), which is the driving frequency of the organic light-emitting display device, the driving frequency of the initialization signal GI may be N Hz, which is the driving frequency of the organic light-emitting display device, and the driving frequency of the second gate signal GW2 may be N Hz (e.g., 30 Hz), which is the driving frequency of the organic light-emitting display device. In an embodiment, the driving frequency of the emission control signal EM may be M Hz (e.g., 60 Hz), which is higher than the driving frequency of the organic light-emitting display device. In this case, because the first compensation transistor CT1 that is controlled by the first gate signal GW1, the initialization transistor IT that is controlled by the initialization signal GI, and the second compensation transistor CT2 that is controlled by the second gate signal GW2 are turned off in the hold non-light-emitting period IP+CWP of an image frame, the first leakage current LC1 flowing from the fourth node N4 to the first node N1 through the first compensation transistor CT1 may be large. As described above, the first compensation transistor CT1 that is controlled by the first gate signal GW1 may be turned on during the first time duration in N non-light-emitting periods IP+CWP per second, the initialization transistor IT that is controlled by the initialization signal GI may be turned on during the first time duration in N non-light-emitting periods IP+CWP per second, and the second compensation transistor CT2 that is controlled by the second gate signal GW2 may be turned on during the second time duration in N non-light-emitting periods IP+CWP per second. Here, the first time duration (e.g., two horizontal periods 2H) may be longer than the second time duration (e.g., one horizontal time 1H). Thus, the turn-on voltage level period of the first gate signal GW1 corresponding to the first time duration may be longer than the turn-on voltage level period of the second gate signal GW2 corresponding to the second time duration, and thus the turn-on voltage level period of the second gate signal GW2 corresponding to the second time duration may overlap the turn-on voltage level period of the first gate signal GW1 corresponding to the first time duration. In an embodiment, as illustrated in FIG. 13, a start point of the turn-on voltage level period of the second gate signal GW2 may be consistent with a start point of the turn-on voltage level period of the first gate signal GW1, and an end point of the turn-on voltage level period of the second gate signal GW2 may be before an end point of the turn-on voltage level period of the first gate signal GW1. Thus, since a period where the turn-on voltage level period of the first gate signal GW1 and the turn-on voltage level period of the second gate signal GW2 do not overlap exists in the normal non-light-emitting period IP+CWP of an image frame, the fourth node N4 between the first compensation transistor CT1 and the second compensation transistor CT2 may be out of the floating state in the period where the turn-on voltage level period of the first gate signal GW1 and the turn-on voltage level period of the second gate signal GW2 do not overlap. As a result, the first leakage current LC1 flowing from the fourth node N4 to the first node N1 through the first compensation transistor CT1 may be reduced.

Figure 14:
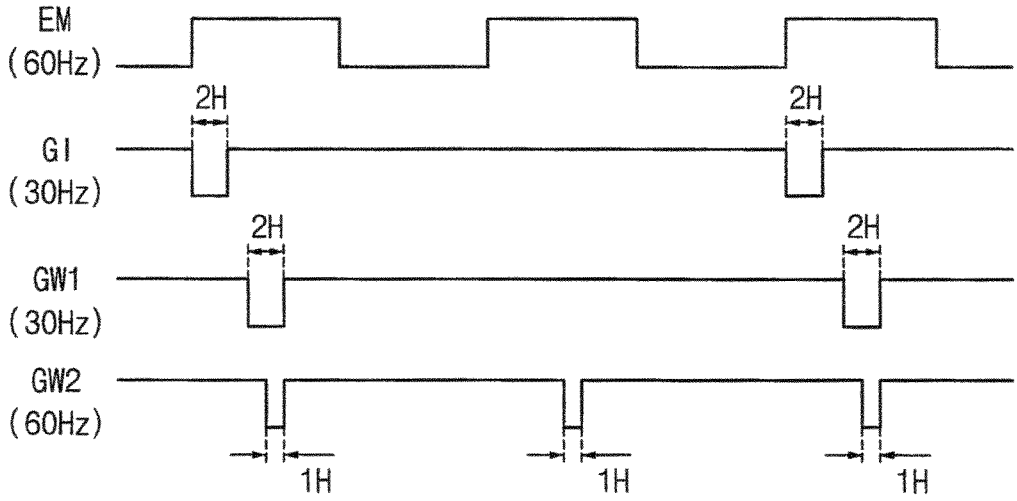
FIG. 14 is a diagram illustrating still another example in which the pixel circuit of FIG. 2 operates in a low-frequency driving mode.

FIG. 14 is a diagram illustrating still another example in which the pixel circuit of FIG. 2 operates in a low-frequency driving mode.

Referring to FIG. 14, in the low-frequency driving mode of the organic light-emitting display device, the driving frequency of the first gate signal GW1 may be N Hz (e.g., 30 Hz), which is the driving frequency of the organic light-emitting display device, the driving frequency of the initialization signal GI may be N Hz, which is the driving frequency of the organic light-emitting display device, and the driving frequency of the second gate signal GW2 may be M Hz (e.g., 60 Hz), which is higher than the driving frequency of the organic light-emitting display device. In an embodiment, the driving frequency of the emission control signal EM may be equal to the driving frequency of the second gate signal GW2. As described above, the first compensation transistor CT1 that is controlled by the first gate signal GW1 may be turned on during the first time duration in N non-light-emitting periods IP+CWP per second, the initialization transistor IT that is controlled by the initialization signal GI may be turned on during the first time duration in N non-light-emitting periods IP+CWP per second, and the second compensation transistor CT2 that is controlled by the second gate signal GW2 may be turned on during the second time duration in M non-light-emitting periods IP+CWP per second. Here, the first time duration (e.g., two horizontal periods 2H) may be longer than the second time duration (e.g., one horizontal time 1H). Thus, the turn-on voltage level period of the first gate signal GW1 corresponding to the first time duration may be longer than the turn-on voltage level period of the second gate signal GW2 corresponding to the second time duration, and thus the turn-on voltage level period of the second gate signal GW2 corresponding to the second time duration may overlap the turn-on voltage level period of the first gate signal GW1 corresponding to the first time duration. In an embodiment, as illustrated in FIG. 14, a start point of the turn-on voltage level period of the second gate signal GW2 may be after a start point of the turn-on voltage level period of the first gate signal GW1, and an end point of the turn-on voltage level period of the second gate signal GW2 may be consistent with an end point of the turn-on voltage level period of the first gate signal GW1. Thus, since a period where the turn-on voltage level period of the first gate signal GW1 and the turn-on voltage level period of the second gate signal GW2 do not overlap exists in the normal non-light-emitting period IP+CWP of an image frame, the fourth node N4 between the first compensation transistor CT1 and the second compensation transistor CT2 may be out of the floating state in the period where the turn-on voltage level period of the first gate signal GW1 and the turn-on voltage level period of the second gate signal GW2 do not overlap. In the hold non-light-emitting period IP+CWP of the image frame, the second compensation transistor CT2 may be turned on during the second time duration, and thus the fourth node N4 between the first compensation transistor CT1 and the second compensation transistor CT2 may be out of the floating state. As a result, the first leakage current LC1 flowing from the fourth node N4 to the first node N1 through the first compensation transistor CT1 may be reduced. In some embodiments, the start point of the turn-on voltage level period of the second gate signal GW2 may be after the start point of the turn-on voltage level period of the first gate signal GW1, and the end point of the turn-on voltage level period of the second gate signal GW2 may be before the end point of the turn-on voltage level period of the first gate signal GW1.

Figure 15:
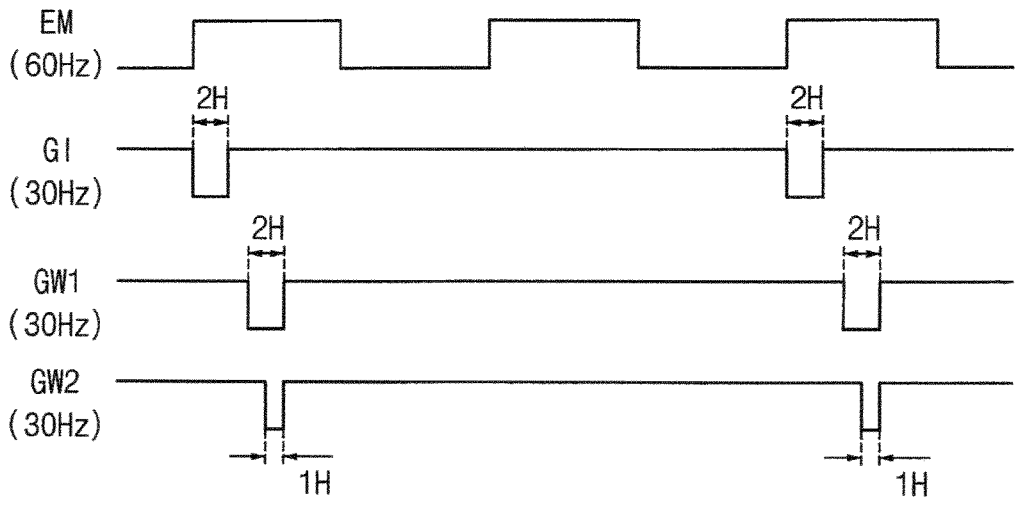
FIG. 15 is a diagram illustrating still another example in which the pixel circuit of FIG. 2 operates in a low-frequency driving mode.

FIG. 15 is a diagram illustrating still another example in which the pixel circuit of FIG. 2 operates in a low-frequency driving mode.

Referring to FIG. 15, in the low-frequency driving mode of the organic light-emitting display device, the driving frequency of the first gate signal GW1 may be N Hz (e.g., 30 Hz), which is the driving frequency of the organic light-emitting display device, the driving frequency of the initialization signal GI may be N Hz, which is the driving frequency of the organic light-emitting display device, and the driving frequency of the second gate signal GW2 may be N Hz (e.g., 30 Hz), which is the driving frequency of the organic light-emitting display device. In an embodiment, the driving frequency of the emission control signal EM may be M Hz (e.g., 60 Hz), which is higher than the driving frequency of the organic light-emitting display device. In this case, because the first compensation transistor CT1 that is controlled by the first gate signal GW1, the initialization transistor IT that is controlled by the initialization signal GI, and the second compensation transistor CT2 that is controlled by the second gate signal GW2 are turned off in the hold non-light-emitting period IP+CWP of an image frame, the first leakage current LC1 flowing from the fourth node N4 to the first node N1 through the first compensation transistor CT1 may be large. As described above, the first compensation transistor CT1 that is controlled by the first gate signal GW1 may be turned on during the first time duration in N non-light-emitting periods IP+CWP per second, the initialization transistor IT that is controlled by the initialization signal GI may be turned on during the first time duration in N non-light-emitting periods IP+CWP per second, and the second compensation transistor CT2 that is controlled by the second gate signal GW2 may be turned on during the second time duration in N non-light-emitting periods IP+CWP per second. Here, the first time duration (e.g., two horizontal periods 2H) may be longer than the second time duration (e.g., one horizontal time 1H). Thus, the turn-on voltage level period of the first gate signal GW1 corresponding to the first time duration may be longer than the turn-on voltage level period of the second gate signal GW2 corresponding to the second time duration, and thus the turn-on voltage level period of the second gate signal GW2 corresponding to the second time duration may overlap the turn-on voltage level period of the first gate signal GW1 corresponding to the first time duration. In an embodiment, as illustrated in FIG. 15, a start point of the turn-on voltage level period of the second gate signal GW2 may be after a start point of the turn-on voltage level period of the first gate signal GW1, and an end point of the turn-on voltage level period of the second gate signal GW2 may be consistent with an end point of the turn-on voltage level period of the first gate signal GW1. Thus, since a period where the turn-on voltage level period of the first gate signal GW1 and the turn-on voltage level period of the second gate signal GW2 do not overlap exists in the normal non-light-emitting period IP+CWP of an image frame, the fourth node N4 between the first compensation transistor CT1 and the second compensation transistor CT2 may be out of the floating state in the period where the turn-on voltage level period of the first gate signal GW1 and the turn-on voltage level period of the second gate signal GW2 do not overlap. As a result, the first leakage current LC1 flowing from the fourth node N4 to the first node N1 through the first compensation transistor CT1 may be reduced.

Figure 16:
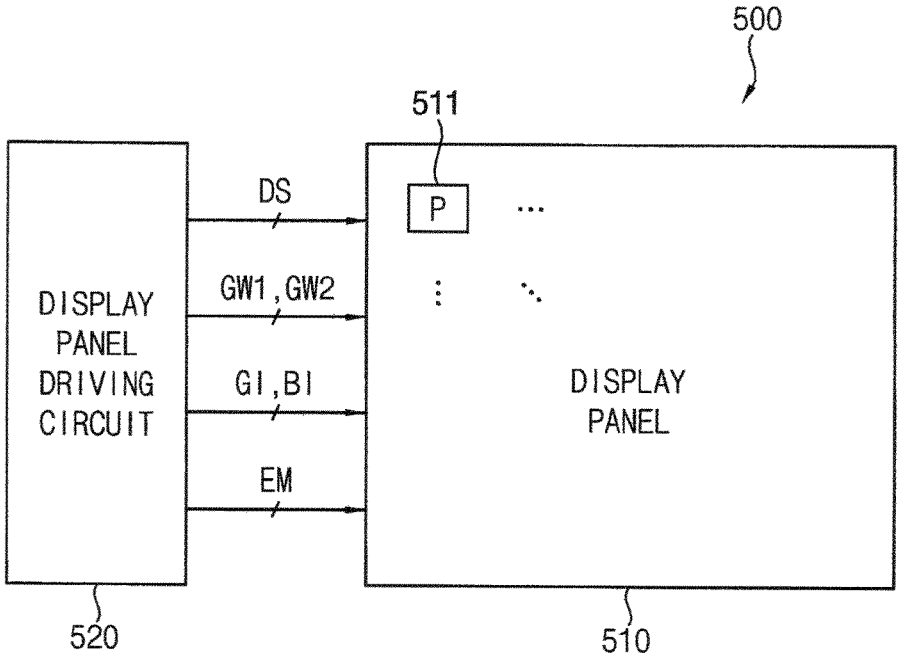
FIG. 16 is a block diagram illustrating an embodiment of an organic light-emitting display device.

FIG. 16 is a block diagram illustrating an embodiment of an organic light-emitting display device.

Referring to FIG. 16, the organic light-emitting display device 500 may include a display panel 510 and a display panel driving circuit 520.

The display panel 510 may include a plurality of pixel circuits 511. Each of the pixel circuits 511 may include a main circuit and a sub circuit. The main circuit may allow a driving current corresponding to the data signal DS applied via a data line to flow into an organic light-emitting element so that the organic light-emitting element may emit light. In an embodiment, the main circuit may include the organic light-emitting element, a storage capacitor, a switching transistor, a driving transistor, a first emission control transistor, and a second emission control transistor, for example. In some embodiments, the main circuit may include only one of the first emission control transistor and the second emission control transistor. The sub circuit may perform an initializing operation and/or a threshold voltage compensating operation of the pixel circuit 511. In an embodiment, the sub circuit may include a first compensation transistor, a second compensation transistor, an initialization transistor, and a bypass transistor, for example. In a low-frequency driving mode of the organic light-emitting display device 500, a driving frequency of a first gate signal GW1 that controls the first compensation transistor may be N Hz, which is a driving frequency of the organic light-emitting display device 500, a driving frequency of a second gate signal GW2 that controls the second compensation transistor may be M Hz, which is higher than the driving frequency of the organic light-emitting display device 500, the first compensation transistor may be turned on during a first time duration in N non-light-emitting periods per second, and the second compensation transistor may be turned on during a second time duration in M non-light-emitting periods per second. In addition, in the low-frequency driving mode of the organic light-emitting display device 500, a driving frequency of an initialization signal GI that controls the initialization transistor may be N Hz, which is the driving frequency of the organic light-emitting display device 500, a driving frequency of a bypass signal BI that controls the bypass transistor may be N Hz, which is the driving frequency of the organic light-emitting display device 500, the initialization transistor may be turned on during the first time duration in N non-light-emitting periods per second, and the bypass transistor may be turned on during the first time duration in N non-light-emitting periods per second. In an embodiment, the first time duration may be equal to the second time duration. In another embodiment, the first time duration may be different from the second time duration. Since these are described above, duplicated description related thereto will not be repeated.

The display panel driving circuit 520 may provide various signals DS, GW1, GW2, GI, BI, and EM to the display panel 510 so that the display panel 510 may operate. That is, the display panel driving circuit 520 may drive the display panel 510. In an embodiment, the display panel driving circuit 520 may include a first gate signal generating circuit, a second gate signal generating circuit, an initialization signal generating circuit, a bypass signal generating circuit, a data signal generating circuit, an emission control signal generating circuit, a timing control circuit, etc. The first gate signal generating circuit may generate the first gate signal GW1 having a driving frequency of N Hz. The second gate signal generating circuit may generate the second gate signal GW2 having a driving frequency of M Hz. The initialization signal generating circuit may generate the initialization signal GI having a driving frequency of N Hz. In some embodiments, the initialization signal GI may be replaced with the first gate signal GW1 that is applied to an adjacent gate line (or referred to as an adjacent horizontal line). In this case, the display panel driving circuit 520 may not include the initialization signal generating circuit. The bypass signal generating circuit may generate the bypass signal BI having a driving frequency of N Hz. In some embodiments, the bypass signal may be same as the initialization signal GI. In this case, the display panel driving circuit 520 may not include the bypass signal generating circuit. The emission control signal generating circuit may generate the emission control signal EM. The timing control circuit may generate a plurality of control signals to control the first gate signal generating circuit, the second gate signal generating circuit, the initialization signal generating circuit, the bypass signal generating circuit, the data signal generating circuit, the emission control signal generating circuit, etc. In some embodiments, the timing control circuit may receive image data, may perform a predetermined data processing (e.g., deterioration compensation, etc.) on the image data, and may provide the processed image data to the data signal generating circuit. As described above, the organic light-emitting display device 500 may have a structure including the first compensation transistor and the second compensation transistor that are connected in series between a gate terminal of a driving transistor and one terminal of the driving transistor (i.e., referred to as a dual structure). Here, in the low-frequency driving mode, the organic light-emitting display device 500 may turn on the first compensation transistor and the initialization transistor during a first time duration in N non-light-emitting periods per second and may turn on the second compensation transistor during a second time in M non-light-emitting periods per second, where M is an integer greater than N. Thus, the organic light-emitting display device 500 may prevent a flicker that a viewer recognizes from occurring when the organic light-emitting display device 500 operates in the low-frequency driving mode. As a result, the organic light-emitting display device 500 may provide a high-quality image to the viewer.

Figure 17:
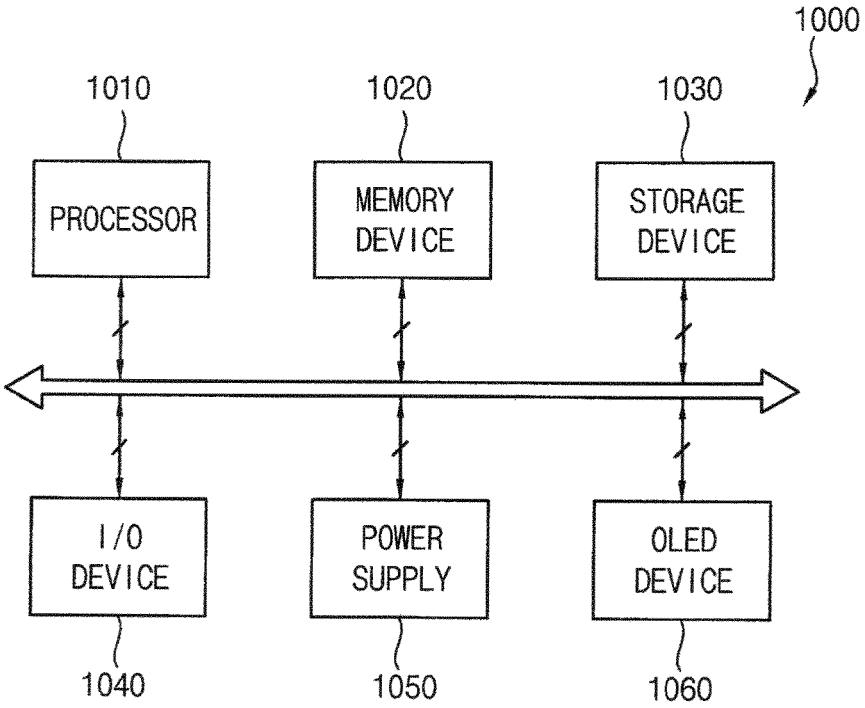
FIG. 17 is a block diagram illustrating an embodiment of an electronic device.
Figure 18:
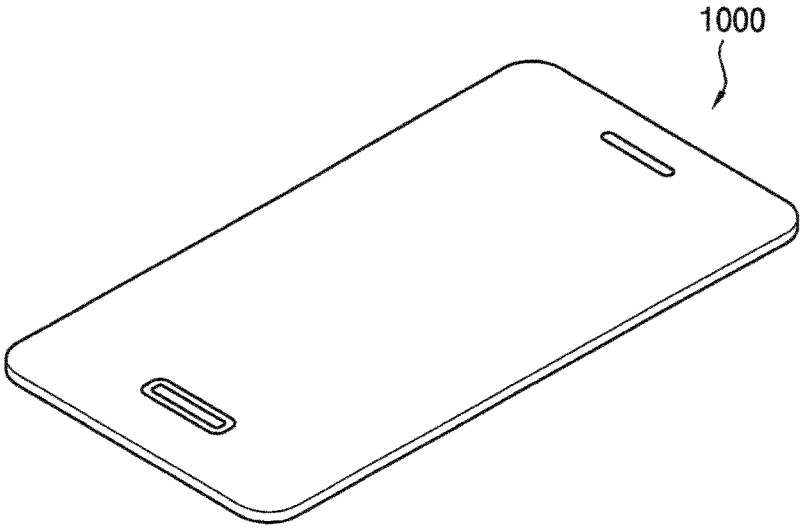
FIG. 18 is a diagram illustrating an example in which the electronic device of FIG. 17 is implemented as a smart phone.

FIG. 17 is a block diagram illustrating an embodiment of an electronic device, and FIG. 18 is a diagram illustrating an example in which the electronic device of FIG. 17 is implemented as a smart phone.

Referring to FIGS. 17 and 18, the electronic device 1000 may include a processor 1010, a memory device 1020, a storage device 1030, an input/output ("I/O") device 1040, a power supply 1050, and an organic light-emitting display device 1060. Here, the organic light-emitting display device 1060 may be the organic light-emitting display device 500 of FIG. 16. In addition, the electronic device 1000 may further include a plurality of ports for communicating with a video card, a sound card, a memory card, a universal serial bus ("USB") device, other electronic devices, etc. In an embodiment, as illustrated in FIG. 18, the electronic device 1000 may be implemented as a smart phone. However, the electronic device 1000 is not limited thereto. In an embodiment, the electronic device 1000 may be implemented as a cellular phone, a video phone, a smart pad, a smart watch, a tablet personal computer ("PC"), a car navigation system, a computer monitor, a laptop, a head mounted display ("HMD") device, etc., for example.

The processor 1010 may perform various computing functions. The processor 1010 may be a micro-processor, a central processing unit ("CPU"), an application processor ("AP"), etc. The processor 1010 may be coupled to other components via an address bus, a control bus, a data bus, etc. Further, the processor 1010 may be coupled to an extended bus such as a peripheral component interconnection ("PCI") bus. The memory device 1020 may store data for operations of the electronic device 1000. In an embodiment, the memory device 1020 may include at least one non-volatile memory device such as an erasable programmable read-only memory ("EPROM") device, an electrically erasable programmable read-only memory ("EEPROM") device, a flash memory device, a phase change random access memory ("PRAM") device, a resistance random access memory ("RRAM") device, a nano floating gate memory ("NFGM") device, a polymer random access memory ("PoRAM") device, a magnetic random access memory ("MRAM") device, a ferroelectric random access memory ("FRAM") device, etc., and/or at least one volatile memory device such as a dynamic random access memory ("DRAM") device, a static random access memory ("SRAM") device, a mobile DRAM device, etc., for example. The storage device 1030 may include a solid state drive ("SSD") device, a hard disk drive ("HDD") device, a CD-ROM device, etc. The I/O device 1040 may include an input device such as a keyboard, a keypad, a mouse device, a touch-pad, a touch-screen, etc., and an output device such as a printer, a speaker, etc. In some embodiments, the I/O device 1040 may include the organic light-emitting display device 1060. The power supply 1050 may provide power for operations of the electronic device 1000. The organic light-emitting display device 1060 may be coupled to other components via the buses or other communication links.

As described above, the organic light-emitting display device 1060 may include a display panel that includes pixel circuits and a display panel driving circuit that drives the display panel. Here, each of the pixel circuits included in the organic light-emitting display device 1060 may minimize (or reduce) a leakage current flowing through the first compensation transistor and the initialization transistor when the organic light-emitting display device 1060 operates in a low-frequency driving mode by having a structure including a first compensation transistor and a second compensation transistor that are connected in series between a gate terminal and one terminal of a driving transistor, where one terminal of the first compensation transistor is connected to the gate terminal of the driving transistor, and one terminal of the second compensation transistor is connected to the one terminal of the driving transistor, by turning on the first compensation transistor and the initialization transistor during a first time duration in N non-light-emitting periods per second, where N is a positive integer, when the organic light-emitting display device 1060 operates in the low-frequency driving mode (i.e., a driving frequency of a first gate signal that controls the first compensation transistor and a driving frequency of an initialization signal that controls the initialization transistor may be N Hz, which is a driving frequency of the organic light-emitting display device 1060), and by turning on the second compensation transistor during a second time duration in M non-light-emitting periods per second, where M is an integer greater than N, when the organic light-emitting display device 1060 operates in the low-frequency driving mode (i.e., a driving frequency of a second gate signal that controls the second compensation transistor may be M Hz, which is higher than the driving frequency of the organic light-emitting display device 1060). Thus, each of the pixel circuits included in the organic light-emitting display device 1060 may prevent (or reduce) a flicker that a viewer recognizes (i.e., may prevent a change in a voltage of the gate terminal of the driving transistor). As a result, the organic light-emitting display device 1060 may provide a high-quality image to the viewer. Since the pixel circuit is described above, duplicated description related thereto will not be repeated.

The invention may be applied to an organic light-emitting display device and an electronic device including the organic light-emitting display device. In an embodiment, the invention may be applied to various electronic devices such as a smart phone, a cellular phone, a video phone, a smart pad, a smart watch, a tablet PC, a car navigation system, a television, a computer monitor, a laptop, an HMD device, an MP3 player, etc.

The foregoing is illustrative of embodiments and is not to be construed as limiting thereof. Although a few embodiments have been described, those skilled in the art will readily appreciate that many modifications are possible in the embodiments without materially departing from the novel teachings and advantages of the invention. Accordingly, all such modifications are intended to be included within the scope of the invention as defined in the claims. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims.

What is claimed is:

1. A pixel circuit comprising:

a main circuit including a driving transistor which includes a gate terminal which is connected to a first node, a first terminal which is connected to a second node, and a second terminal which is connected to a third node and an organic light-emitting element which is connected to the driving transistor between a first power voltage and a second power voltage and controls the organic light-emitting element to emit light by controlling a driving current corresponding to a data signal which is applied via a data line to flow into the organic light-emitting element; and a sub circuit including a first compensation transistor which includes a gate terminal which receives a first gate signal, a first terminal which is connected to the first node, and a second terminal which is connected to a fourth node, a second compensation transistor which includes a gate terminal which receives a second gate signal, a first terminal which is connected to the fourth node, and a second terminal which is connected to the third node, and an initialization transistor which includes a gate terminal which receives an initialization signal, a first terminal which is connected to the first node, and a second terminal which receives an initialization voltage, wherein in a low-frequency driving mode, a driving frequency of the first gate signal is N Hz, which is a driving frequency of an organic light-emitting display device, where N is a positive integer, a driving frequency of the initialization signal is N hertz, a driving frequency of the second gate signal is M hertz, where M is a positive integer and different from N, the first compensation transistor and the initialization transistor are turned on during a first time duration in N non-light-emitting periods per second, and the second compensation transistor is turned on during a second time duration in M non-light-emitting periods per second.

2. The pixel circuit of claim 1, wherein in the low-frequency driving mode, the driving frequency of the first gate signal and the driving frequency of the initialization signal are lower than the driving frequency of the second gate signal.

3. The pixel circuit of claim 2, wherein the first gate signal and the second gate signal are generated, respectively by respective signal generating circuits which are independent of each other.

4. The pixel circuit of claim 1, wherein the first time duration is equal to the second time duration.

5. The pixel circuit of claim 4, wherein a turn-on voltage level period of the second gate signal is consistent with a turn-on voltage level period of the first gate signal.

6. The pixel circuit of claim 5, wherein in a normal non-light-emitting period in which an initializing operation and a threshold voltage compensating and data writing operation are performed, the first compensation transistor and the second compensation transistor are simultaneously turned on and then off after the initialization transistor is turned on and then off.

7. The pixel circuit of claim 6, wherein in a hold non-light-emitting period in which the initializing operation and the threshold voltage compensating and data writing operation are not performed, only the second compensation transistor is turned on and then off.

8. The pixel circuit of claim 7, wherein the initialization voltage is changed from a first voltage level to a second voltage level which is higher than the first voltage level at a start point of the hold non-light-emitting period, and the initialization voltage is reset to the first voltage level at a start point of the normal non-light-emitting period.

9. The pixel circuit of claim 8, wherein the initialization voltage is additionally changed to at least one voltage level which is higher than the second voltage level after the initialization voltage is changed to the second voltage level at the start point of the hold non-light-emitting period.

10. The pixel circuit of claim 1, wherein the first time duration is longer than the second time duration.

11. The pixel circuit of claim 10, wherein a turn-on voltage level period of the second gate signal overlaps a turn-on voltage level period of the first gate signal.

12. The pixel circuit of claim 11, wherein a start point of the turn-on voltage level period of the second gate signal is consistent with a start point of the turn-on voltage level period of the first gate signal, and an end point of the turn-on voltage level period of the second gate signal is before an end point of the turn-on voltage level period of the first gate signal.

13. The pixel circuit of claim 11, wherein a start point of the turn-on voltage level period of the second gate signal is after a start point of the turn-on voltage level period of the first gate signal, and an end point of the turn-on voltage level period of the second gate signal is consistent with an end point of the turn-on voltage level period of the first gate signal.

14. The pixel circuit of claim 11, wherein a start point of the turn-on voltage level period of the second gate signal is after a start point of the turn-on voltage level period of the first gate signal, and an end point of the turn-on voltage level period of the second gate signal is before an end point of the turn-on voltage level period of the first gate signal.

15. The pixel circuit of claim 11, wherein in a normal non-light-emitting period in which an initializing operation and a threshold voltage compensating and data writing operation are performed, the second compensation transistor is turned on and then off while the first compensation transistor is turned on after the initialization transistor is turned on and then off.

16. The pixel circuit of claim 15, wherein in a hold non-light-emitting period in which the initializing operation and the threshold voltage compensating and data writing operation are not performed, only the second compensation transistor is turned on and then off.

17. The pixel circuit of claim 16, wherein the initialization voltage is changed from a first voltage level to a second voltage level which is higher than the first voltage level at a start point of the hold non-light-emitting period, and the initialization voltage is reset to the first voltage level at a start point of the normal non-light-emitting period.

18. The pixel circuit of claim 17, wherein the initialization voltage is additionally changed to at least one voltage level which is higher than the second voltage level after the initialization voltage is changed to the second voltage level at the start point of the hold non-light-emitting period.

19. The pixel circuit of claim 1, wherein the sub circuit further includes a bypass transistor including a gate terminal which receives a bypass signal, a first terminal which receives the initialization voltage, and a second terminal which is connected to an anode of the organic light-emitting element, and wherein in the low-frequency driving mode, a driving frequency of the bypass signal is N hertz, and the bypass transistor is turned on during the first time duration in N non-light-emitting periods per second.

20. The pixel circuit of claim 19, wherein the bypass signal is a same signal as the initialization signal.

* * * * *